US007802455B2

(12) United States Patent
Herdman

(10) Patent No.: US 7,802,455 B2
(45) Date of Patent: Sep. 28, 2010

(54) PROGRAMMABLE LOCK HAVING INCIDENTAL CHANGE CONTROL

(75) Inventor: Rodrick A. Herdman, West Chester, OH (US)

(73) Assignee: JaNaKa Limited Partnership, Mason, OH (US)

( * ) Notice: Subject to any disclaimer, the term of this patent is extended or adjusted under 35 U.S.C. 154(b) by 0 days.

(21) Appl. No.: 12/116,592

(22) Filed: May 7, 2008

(65) Prior Publication Data

US 2008/0276675 A1 Nov. 13, 2008

Related U.S. Application Data

(60) Provisional application No. 60/916,367, filed on May 7, 2007.

(51) Int. Cl.
*E05B 27/00* (2006.01)
*E05B 25/00* (2006.01)

(52) U.S. Cl. ..... 70/493; 70/382; 70/384; 70/385

(58) Field of Classification Search ..... 70/182–186, 70/233, 382–385, 493, 208; 292/216, DIG. 30, 292/DIG. 31, DIG. 42, DIG. 43
See application file for complete search history.

(56) References Cited

U.S. PATENT DOCUMENTS

| | | | | |
|---|---|---|---|---|
| 1,218,065 A | | 3/1917 | Diesel | 70/492 |
| 1,650,568 A | | 5/1927 | Hurd | 70/338 |
| 1,967,042 A | | 7/1934 | Schachinger | 70/382 |
| 2,023,847 A | | 12/1935 | Liss | 70/494 |
| 2,113,007 A | * | 4/1938 | Swanson | 70/340 |
| 2,202,329 A | | 5/1940 | Braune | 70/419 |
| 2,294,495 A | | 9/1942 | Woodruff | 70/493 |

(Continued)

FOREIGN PATENT DOCUMENTS

CA 695186 9/1964

(Continued)

OTHER PUBLICATIONS

MasterLock brochure, Apr. 2003, "Key Control Security", MO-15M (2 pages).

(Continued)

*Primary Examiner*—Suzanne D Barrett
(74) *Attorney, Agent, or Firm*—Hasse & Nesbitt LLC; Daniel F. Nesbitt

(57) ABSTRACT

A key-operated cylinder lock for operating a bolt or a latch, that can be programmed for use with one of a plurality of user keys without disassembling the lock or replacing the tumblers, with reduction or elimination of incidental or accidental re-keying of the lock. The lock has a rotating plug having one or more retainer cavities formed into the periphery, and lock configuration change balls, movable within the lock between a first position within a driver chamber and a second position within a corresponding retainer cavity when the plug is in a programming position. The positioning of the change balls within either the pin chambers or the retainer cavities determines the key configuration that can operate the lock. The lock employs a means for isolating selectively the retainer cavities from the corresponding driver chambers when the plug is in the programming position, to prevent incidental or accidental movement of the change members from the driver chamber into the retainer cavities.

6 Claims, 15 Drawing Sheets

U.S. PATENT DOCUMENTS

| | | | | | |
|---|---|---|---|---|---|
| 2,427,837 | A | | 7/1944 | Connell | 70/383 |
| 2,596,720 | A | | 5/1952 | Pastor et al. | 70/493 |
| 2,629,249 | A | | 2/1953 | Mendelsohn | 70/419 |
| 2,687,640 | A | | 8/1954 | Mir et al. | 70/492 |
| 2,818,723 | A | * | 1/1958 | Levin | 70/383 |
| 3,070,987 | A | | 1/1963 | Baker et al. | 70/383 |
| 3,149,486 | A | * | 9/1964 | Russell et al. | 70/384 |
| 3,183,692 | A | * | 5/1965 | Check | 70/383 |
| 3,234,768 | A | | 2/1966 | Russell et al. | 70/383 |
| 3,257,831 | A | | 6/1966 | Schlage | 70/383 |
| 3,260,080 | A | | 7/1966 | Wellekens | 70/492 |
| 3,286,494 | A | | 11/1966 | Sussina | 70/419 |
| 3,320,781 | A | | 5/1967 | Hill | 70/384 |
| 3,395,558 | A | * | 8/1968 | Russell et al. | 70/493 |
| 3,425,248 | A | | 2/1969 | Duval | 70/421 |
| 3,431,757 | A | | 3/1969 | Hori | 70/383 |
| 3,492,843 | A | | 2/1970 | Schieber et al. | 70/388 |
| 3,512,382 | A | | 5/1970 | Check et al. | 70/384 |
| 3,516,271 | A | * | 6/1970 | Nelson et al. | 70/383 |
| 3,589,153 | A | | 6/1971 | Hill | 70/384 |
| 3,599,456 | A | | 8/1971 | Bessim | 70/383 |
| 3,605,462 | A | | 9/1971 | Hermann | |
| 3,667,262 | A | | 6/1972 | Hill | 70/384 |
| 3,710,603 | A | | 1/1973 | Miller | 70/38 A |
| 3,774,424 | A | | 11/1973 | Ehrat | 70/383 |
| 3,910,083 | A | | 10/1975 | Burlingame | 70/383 |
| 3,967,481 | A | | 7/1976 | Schlage | 70/431 |
| 4,030,325 | A | | 6/1977 | Ehrat | 70/383 |
| 4,068,508 | A | | 1/1978 | Genakis | 70/373 |
| 4,116,026 | A | | 9/1978 | Flint | 70/383 |
| 4,142,391 | A | | 3/1979 | Paig | 70/461 |
| 4,151,731 | A | | 5/1979 | Tucker | 70/378 |
| RE30,198 | E | | 1/1980 | Oliver et al. | 70/378 |
| 4,231,242 | A | | 11/1980 | Hill et al. | 70/347 |
| 4,233,828 | A | | 11/1980 | Dauenbaugh | 70/383 |
| 4,282,731 | A | * | 8/1981 | Taksony | 70/493 |
| 4,372,139 | A | | 2/1983 | Laake | 70/383 |
| 4,376,382 | A | | 3/1983 | Raymond et al. | 70/338 |
| 4,403,486 | A | * | 9/1983 | Miyake | 70/383 |
| 4,412,437 | A | | 11/1983 | Smith | 70/338 |
| 4,429,555 | A | | 2/1984 | Slasbury | 70/366 |
| 4,440,009 | A | | 4/1984 | Smith | 70/385 |
| 4,631,941 | A | * | 12/1986 | Sjunnesson | 70/337 |
| 4,638,651 | A | | 1/1987 | Surko, Jr. | 70/419 |
| 4,655,063 | A | | 4/1987 | Foshee et al. | 70/419 |
| 4,712,401 | A | | 12/1987 | Monahan | 70/382 |
| 4,712,402 | A | | 12/1987 | Monahan | 70/383 |
| 4,732,023 | A | | 3/1988 | Shen | 70/838 |
| 4,741,188 | A | | 5/1988 | Smith | 70/383 |
| 4,747,281 | A | * | 5/1988 | Monahan | 70/383 |
| 4,776,187 | A | | 10/1988 | Evans et al. | 70/38 A |
| 4,836,002 | A | * | 6/1989 | Monahan | 70/382 |
| 4,942,749 | A | | 7/1990 | Rabinow | 70/495 |
| 4,966,021 | A | | 10/1990 | Boag | 70/383 |
| 5,000,019 | A | * | 3/1991 | Foster | 70/338 |
| 5,088,306 | A | | 2/1992 | Field | 70/375 |
| 5,138,856 | A | * | 8/1992 | Chyun | 70/493 |
| 5,168,734 | A | | 12/1992 | Duval et al. | 70/364 |
| 5,177,466 | A | | 1/1993 | Lai | 70/358 |
| 5,211,044 | A | | 5/1993 | Kim | 70/371 |
| 5,343,724 | A | | 9/1994 | Sornes | 70/340 |
| 5,450,662 | A | | 9/1995 | Watts | 29/401.1 |
| 5,502,991 | A | | 4/1996 | Sornes | 70/453 |
| 5,531,084 | A | | 7/1996 | Laabs et al. | 70/409 |
| 5,615,566 | A | | 4/1997 | Brandt | 70/419 |
| 5,682,779 | A | | 11/1997 | Dolev | 70/494 |
| 5,718,136 | A | | 2/1998 | Aldieri et al. | 70/385 |
| 5,752,400 | A | | 5/1998 | Kim | 70/368 |
| 5,799,519 | A | * | 9/1998 | Hsiao | 70/358 |
| 5,819,569 | A | | 10/1998 | Herdman | 70/420 |
| 5,839,307 | A | | 11/1998 | Field et al. | 70/283 |
| 5,894,750 | A | | 4/1999 | Liaw | 70/359 |
| 5,921,121 | A | | 7/1999 | Tang | 70/337 |
| 5,921,122 | A | | 7/1999 | Lin | 70/368 |
| 5,964,111 | A | | 10/1999 | Lambert | 70/493 |
| D422,882 | S | | 4/2000 | Andrews | D8/343 |
| 6,076,386 | A | | 6/2000 | Etchells et al. | 70/369 |
| 6,079,240 | A | | 6/2000 | Shvarts | 70/367 |
| 6,301,942 | B1 | | 10/2001 | Shvarts | 70/367 |
| 6,425,274 | B1 | | 7/2002 | Laitala et al. | 70/394 |
| 6,532,782 | B2 | | 3/2003 | Chiu | 70/369 |
| 6,604,393 | B2 | | 8/2003 | Larsen et al. | 70/208 |
| 6,722,171 | B1 | | 4/2004 | Ruan | 70/379 R |
| 6,776,017 | B2 | | 8/2004 | Herdman | 70/382 |
| 6,860,131 | B2 | | 3/2005 | Armstrong et al. | 70/492 |
| 6,935,146 | B1 | * | 8/2005 | Lin | 70/338 |
| 7,290,418 | B2 | * | 11/2007 | Herdman | 70/383 |
| 2001/0047672 | A1 | | 12/2001 | Fuller | 70/375 |
| 2002/0104346 | A1 | | 8/2002 | Field et al. | 70/496 |
| 2003/0041630 | A1 | | 3/2003 | Laitala et al. | 70/38 A |
| 2003/0084692 | A1 | | 5/2003 | Herdman | 70/338 |
| 2003/0159483 | A1 | | 8/2003 | Kondratuk et al. | 70/493 |
| 2003/0217576 | A1 | | 11/2003 | Koluch | 70/493 |
| 2004/0060333 | A1 | | 4/2004 | Armstrong et al. | 70/493 |
| 2004/0221630 | A1 | | 11/2004 | Herdman | 70/493 |
| 2005/0172687 | A1 | | 8/2005 | Segien et al. | 70/493 |
| 2006/0010945 | A1 | | 1/2006 | Herdman | 70/493 |
| 2006/0021406 | A1 | | 2/2006 | Herdman | 70/493 |
| 2007/0193317 | A1 | * | 8/2007 | Herdman | 70/383 |

FOREIGN PATENT DOCUMENTS

| | | |
|---|---|---|
| DE | 2517-689 | 11/1975 |
| DE | 2646-736 | 4/1978 |
| EP | 0918124 A1 | 5/1999 |
| JP | UM 56-97075 | 8/1981 |
| JP | UM 5-007871 | 2/1993 |
| JP | UM 7-15971 | 3/1995 |
| JP | UM 8-10636 | 3/1996 |
| JP | UM 2577146 | 5/1998 |
| JP | 2005-002641 | 1/2005 |
| JP | 2005-076286 | 3/2005 |

OTHER PUBLICATIONS

Schliebanlagen GmbH Pfaffenhaim catalog, 2002, "Locking Systems for Highest Demands", "Profile Cylinder System K14", "Profile Cylinder System V14", "System W14", "Profilcylinder-System Integral" (7 pages).

* cited by examiner

PROGRAMMABLE LOCK HAVING INCIDENTAL CHANGE CONTROL

CROSS-REFERENCE TO RELATED APPLICATIONS

This application claims the benefit of U.S. Provisional Application No. 60/916,367, filed May 7, 2007.

BACKGROUND OF THE INVENTION

This invention relates generally to cylinder locks, and more particularly to a programmable cylinder lock that controls changing of the lock configuration, including incidental of accidental configuration changes.

Pin and tumbler locks are known that can operate with one of a set of user keys, and can be reconfigured without disassembling the lock, as disclosed in US patent Publication 2004-0221630, the disclosure of which is incorporated herein by reference. The lock shows a changeable lock assembly with a plug that rotates within a housing, with a series of pins and tumbler, that when aligned at the interface between the plug and the housing, permit rotation of the plug to lock and unlock a latch or catch. One or more change balls are included in the one or more pin chambers, which can move between the pin chamber and the blind hole formed in the side of the plug, to configure the lock with different keys of a set of user keys, depending upon the configuration of the one or more change balls in either the pin chamber or the blind hole.

With this lock, a phenomenon known as incidental keying can occur. In one circumstance of incidental keying, a user key that operates the lock may be used wherein, while being rotated, the key is being pulled axially in the key removal direction, which can cause a raised contour position in an adjacent pin chamber to incidentally or accidentally raise a change ball up into a change member and then into a corresponding retainer cavity when the plug is rotated to the user position. In another circumstance, an unauthorized user key can have a particular pin position with a contour cut that is slightly higher than that of the authorized user key, so that the unauthorized user key with the slightly higher contour height can incidentally or accidentally cause the change ball to be lifted out of the pin chamber and trapped in the driver chamber as the plug begins to rotate to the second rotated or programming position. When the plug arrives at the change position, the change ball is driven down into the retainer cavity, causing incidental or accidental re-keying, because now the lock will not operate with the original authorized user key.

Thus, it would be desirable to provide a lock, and particularly a lock that permits rapid programming of the tumbler pins or other pins to a different configuration to operate with a different user key, without disassembling the lock or re-pinning (exchanging) the tumbler pins, which reduces or eliminates incidental or accidental re-keying of the lock.

SUMMARY OF THE INVENTION

The present invention provides a cylinder lock for operating a bolt, a latch or other closure mechanism, which can be programmed for use with one of a plurality of user keys without disassembling the lock or exchanging or re-pinning the tumbler pins, with elimination or reduction of incidental or accidental re-keying of the lock.

The present invention relates to a programmable cylinder lock assembly that can be reconfigured to operate with a user key selected from a set of keys, without disassembling the lock. The lock assembly includes: a set of keys comprising a plurality of user keys; a housing having a cylindrical bore with an inner surface and a plurality of driver chambers intersecting the bore surface; a plurality of drivers, each driver being movable within one driver chamber and having a means for urging the drivers toward the inner surface; and a plug having a cylindrical periphery and rotatably mounted within the bore so as to form a shear surface at the interface of the inner surface, the plug being rotatable from a key insertion position to an operating position, and to a programming position. The plug has a keyway configured to receive a key selected from the set of keys, a plurality of tumbler chambers intersecting the plug periphery and the keyway, each tumbler chamber being aligned with a corresponding one of the plurality of driver chambers when the plug is at the key insertion position so as to form a corresponding pin chamber, and at least one retainer cavity disposed within the plug, spaced apart from a corresponding one of the plurality of tumbler chambers, and being alignable with the corresponding driver chamber when the plug is at the programming position. The lock assembly further includes a plurality of tumblers, each tumbler being movable within a corresponding one of the plurality of tumbler chambers, and at least one lock configuration change member, movable within the lock between at least a first position within the corresponding pin chamber or the corresponding driver chamber, and a second position within the corresponding at least one retainer cavity.

The lock further includes a means for isolating the at least one retainer cavity from the corresponding driver chamber when the plug is in the programming position, having a first position of condition that prevents movement of the change member from the corresponding driver chamber into the at least one retainer cavity, and movement of the change member out of the at least one retainer cavity and into the corresponding driver chamber, and a second position that permits or allows such movements.

One embodiment of the isolating means comprises a cavity carriage movably positioned within the plug, within which the at least one retainer cavity is formed, the cavity carriage movable relative to the plug between a first aligned position wherein the at least one retainer cavity is aligned with the corresponding driver chamber, where the change member can be moved between the at least one retainer cavity and the corresponding driver chamber when the plug is in the programming position, and a second non-aligned position wherein the at least one retainer cavity is not aligned with the corresponding driver chamber, and the change member can not be moved between the at least one retainer cavity and the corresponding driver chamber when the plug is in the programming position.

In one such embodiment, a surface of the cavity carriage forms a portion of the periphery of the plug, wherein the at least one retainer cavity and the opening into the cavity are both formed into the surface of the cavity carriage.

In another embodiment, the cavity carriage is disposed within a channel formed within the plug and below or inboard the outer periphery of the plug, wherein the at least one retainer cavity is formed into the cavity carriage, and an opening into the at least one retainer cavity is formed within the outer periphery of the plug. In another such embodiment, the cavity carriage moves by rotation within a first channel of the plug around an axis of the cavity carriage. In another such embodiment, the cavity carriage moves axially within a second channel along an axis of the cavity carriage.

Another embodiment of the isolating means comprises an obstruction associated or integral with the plug, being moveable relative to the plug between a first position that does not block the opening into the at least one retainer cavity formed into the plug, when the plug is in the programming position, and a second position that blocks or obstructs the opening, to prevent movement of the change member from the corresponding driver chamber into the retainer cavity.

In one embodiment, the obstruction is a member that blocks a portion of the opening of the at least one retainer cavity when disposed in the second position. In another embodiment, the obstruction forms a part of the plug periphery, and moves tangentially between the first position and the second position. In yet another such embodiment, the obstruction moves axially between the first position and the second position.

Another embodiment of the present invention can include a means for displacing the at least one change member from the second position within the at least one retainer cavity to the corresponding driver chamber when the lock is in the programming position.

The configuration of the lock for operation with a user key is associated with the positioning of the at least one change members in either the corresponding pin chamber or the corresponding retainer cavity.

The cavity carriage of the lock can optionally have a change slot that intersects a portion of the at least one retainer cavity and can include a change tool that can be manipulated within or engaged in the change slot, whereby the change member can be moved from the second position within the at least one retainer cavity.

The invention also relates to a programmable lock assembly that can further be configured for operation with a temporary access key, associated with a main user key of the set of keys, for temporarily operating the lock. The main user key can be configured alternatively to cancel operation with the associated temporary user key, or to continue allowing operation with the associated temporary user key, when the main user key is again inserted into and operates the lock. Such lock assembly uses a means for positioning a temporary lock configuration change member within the lock for establishing the temporary lock configuration.

The present invention also relates to a lock kit, comprising: a) a programmable lock assembly including a set of keys, as described herein; b) instructions for use; c) optionally a change tool; and d) a means for securing together the lock assembly, the optional change tool, and the instructions.

The present invention relates to a method for moving a change member from the corresponding pin chamber to the corresponding retainer cavity of the lock assembly, comprising the steps of: a) inserting a key having at least one contour position configured to raise a change member disposed in the pin chamber, up into the corresponding driver chamber; b) rotating the plug to the programming position while the at least one change member is in the driver chamber; and c) moving the cavity carriage from its second position to its first position, whereby the change member is moved from the driver chamber into the retainer cavity.

The present invention relates to a method for moving a change member from the corresponding pin chamber to the corresponding retainer cavity of the lock assembly, comprising the steps of: a) inserting a key having at least one contour position configured to raise a change member disposed in the pin chamber, up into the corresponding driver chamber; b) rotating the plug to the programming position while the at least one change member is in the driver chamber; and c) moving an obstruction from its second position to its first position, whereby the change member is moved from the driver chamber into the retainer cavity.

The present invention also relates to a method for moving a change member from the corresponding retainer cavity to the corresponding driver chamber, comprising the steps of: a) inserting a key operable to rotate the plug to the programming position; b) rotating the plug to the programming position; c) moving the cavity carriage from its second position to its first position; d) displacing the at least one change member from the retainer cavity into the corresponding driver chamber; e) rotating the plug to the key insertion position while the at least one change ball is in the driver chamber, thereby disposing the change ball in the pin chamber; f) optionally moving the cavity carriage from the first position to its second position; and g) removing the inserted key.

The present invention also relates to a method for moving a change member from the corresponding retainer cavity to the corresponding driver chamber, comprising the steps of: a) inserting a key operable to rotate the plug to the programming position; b) rotating the plug to the programming position; c) moving the obstruction from its second position to its first position; d) displacing the at least one change member from the retainer cavity into the corresponding driver chamber; e) rotating the plug to the key insertion position while the at least one change ball is in the driver chamber, thereby disposing the change ball in the pin chamber; f) optionally moving the cavity carriage from the first position to its second position; and g) removing the inserted key.

The present invention also relates to a method for programming a lock operable with a first user key, to be operated by a second user key, without disassembling the lock, the method comprising the steps of: a) providing a set of keys comprising at least a first user key and a second user key, and a programming key, each of the keys having a contour edge, the second user key having a different contour edge than the first user key at least one of the corresponding pin chamber positions; b) inserting the programming key into the keyway and rotating the plug to the programming position; c) moving the cavity carriage from its second position to its first position; d) displacing the at least one change member from the corresponding retainer cavity into the corresponding driver chamber; e) rotating the plug to the key insertion position while the at least one change member is in the corresponding driver chamber; f) optionally moving the cavity carriage from its first position back to its second position; and g) removing the programming key, thereby configuring the lock into a reset configuration. The method can further comprise the steps of: h) inserting the second user key while the lock is in the reset configuration, wherein at least one change member is displaced from the corresponding tumbler chamber into a corresponding driver chamber; i) rotating the plug to the programming position while the at least one change member is in the corresponding driver chamber; j) moving the cavity carriage from its second position to its first position, whereby the change member moves from the driver chamber to the corresponding retainer cavity, and k) rotating the plug back to the first position wherein the lock is configured for operation by the second user key.

In another aspect of the invention, the plug of the lock is configured to permit rotation in a first direction to an operating position when using a user key, and in an opposite direction to a programming position when using a programming key, which permits reconfigurating or programming of the lock for use with a different user key. The lock cannot be rotated to the programming position with the user keys.

In another aspect of the invention, the configuration of the lock can be changed to operate with a second user key, and subsequently with a third user key, of the set of keys solely in response to insertion of the second user key, and subsequently the third user key, and rotation of the plug to the operating position. The reconfigured lock then cannot be operated by the first user key, and subsequently the second user key, respectively.

The present invention therefore relates to a key-operated, programmable lock that can operate the lock with any one of a plurality of user keys, and is programmable with a programming key to reconfigure the lock to operate with another one of the plurality of user keys, without disassembling the lock.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

As used herein, the phrase "disassembly of the lock" means the removal of the plug from the bore of the housing and removal of the tumbler pins from the tumbler chambers of the plug, or the removal of an access panel in the housing and removal of the driver pins and tumbler pins.

As used herein, the term "isolating" means the temporary separation of a pin within one chamber or cavity of the lock from another chamber or pin.

As used herein, the term "integral" means a part or element of a lock that is formed as a unit with the other parts or elements of the lock assembly, which can not be separated from the other parts or elements of the lock assembly without disassembly of the lock, and in particular disassembly of the plug from the housing.

A first embodiment of a programmable lock assembly of the present invention is shown in FIGS. 1 through 28. This embodiment shows a programmable lock assembly that can be programmed to operate with one of a plurality of user keys.

Figure 1:
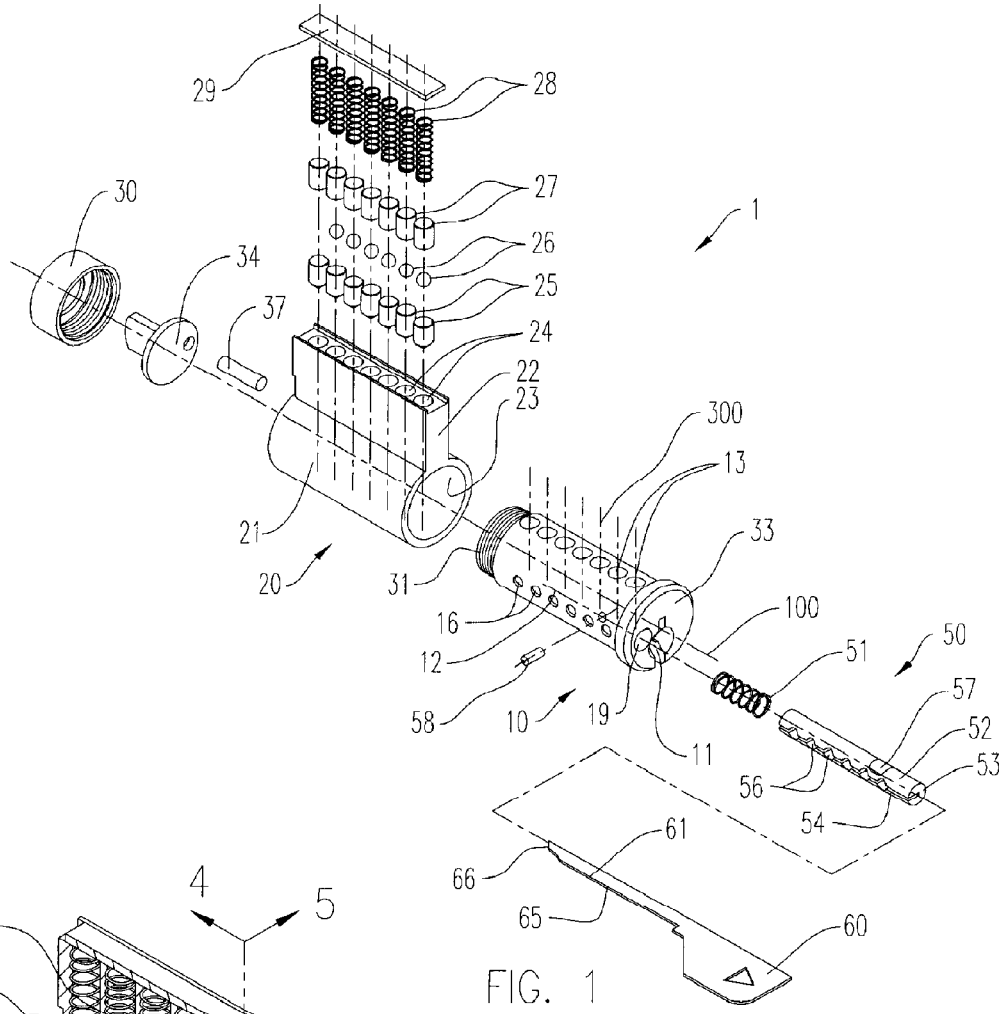
FIG. 1 shows a perspective, exploded view of an embodiment of a programmable lock of the present invention.
Figure 2:
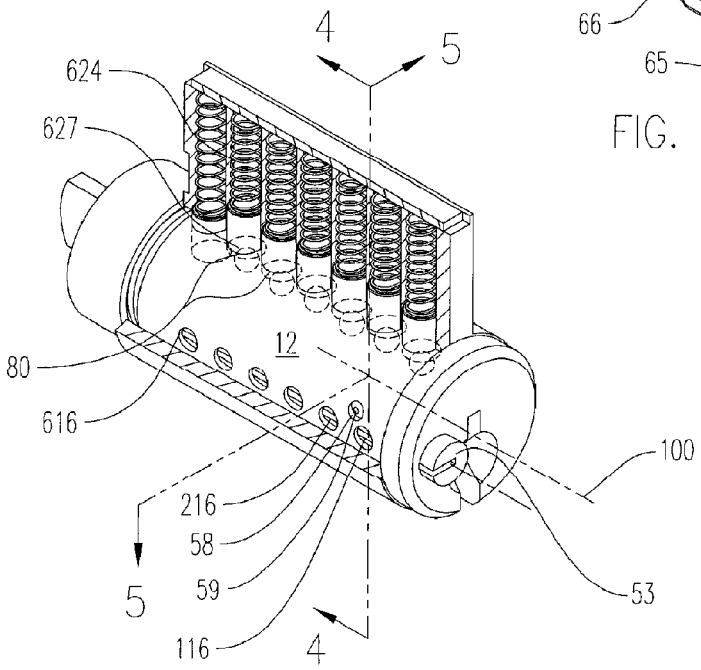
FIG. 2 shows a perspective, assembled view of the same programmable lock.

FIGS. 1 and 2 show the lock assembly that includes a housing 20 having a cylindrical barrel portion 21 and a stack portion 22. The barrel portion 21 has a cylindrical bore that runs through the length of the barrel portion 21 to form an inner surface 23. A plurality of driver chambers 24 are formed along the length of the stack portion 22, and intersect the inner surface 23. The plurality of driver chambers typically includes 5, 6, 7, 8 or 9 such chambers. In the illustrated embodiment, each of the driver chambers 24 has substantially the same diameter, and are aligned transverse to the centerline 100 that passes through the longitudinal center of the barrel portion 21. The plurality of driver chambers 24 corresponding to pin chambers 1 through 7 may be denoted herein after as driver chambers 124, 224, 324, 424, 524, 624 and 724, respectively.

The plug 10 of the lock has a cylindrical periphery 12 that is formed or machined to allow the plug 10 to be mounted rotatably within the inner surface 23 of the housing, such that the centerline of the plug is aligned along the centerline 100 for the housing barrel 21. A cylindrical shear surface is formed at the interface between the periphery 12 of the plug 10 and the inner surface 23 of the housing 20. A shear line or arc 80 forms a portion of the shear surface, at the intersection of the driver chambers 24 with the bore 23 (see FIG. 10).

The lock 1 generally operates under the well-known principle that, provided none of the lock hardware (such as the lock drivers and tumblers, discussed hereinafter) span across the shear line or shear arc 80, then the plug 10 is free to rotate within the bore in either direction, and the lock operates to open a latch, a bolt or other means of securing a door or other device being secured closed by the lock. On the other hand generally, if a driver or a tumbler spans across the shear line 80, then the plug 10 is prevented from rotating within the bore in one or both directions, as shown herein after.

Figure 3:
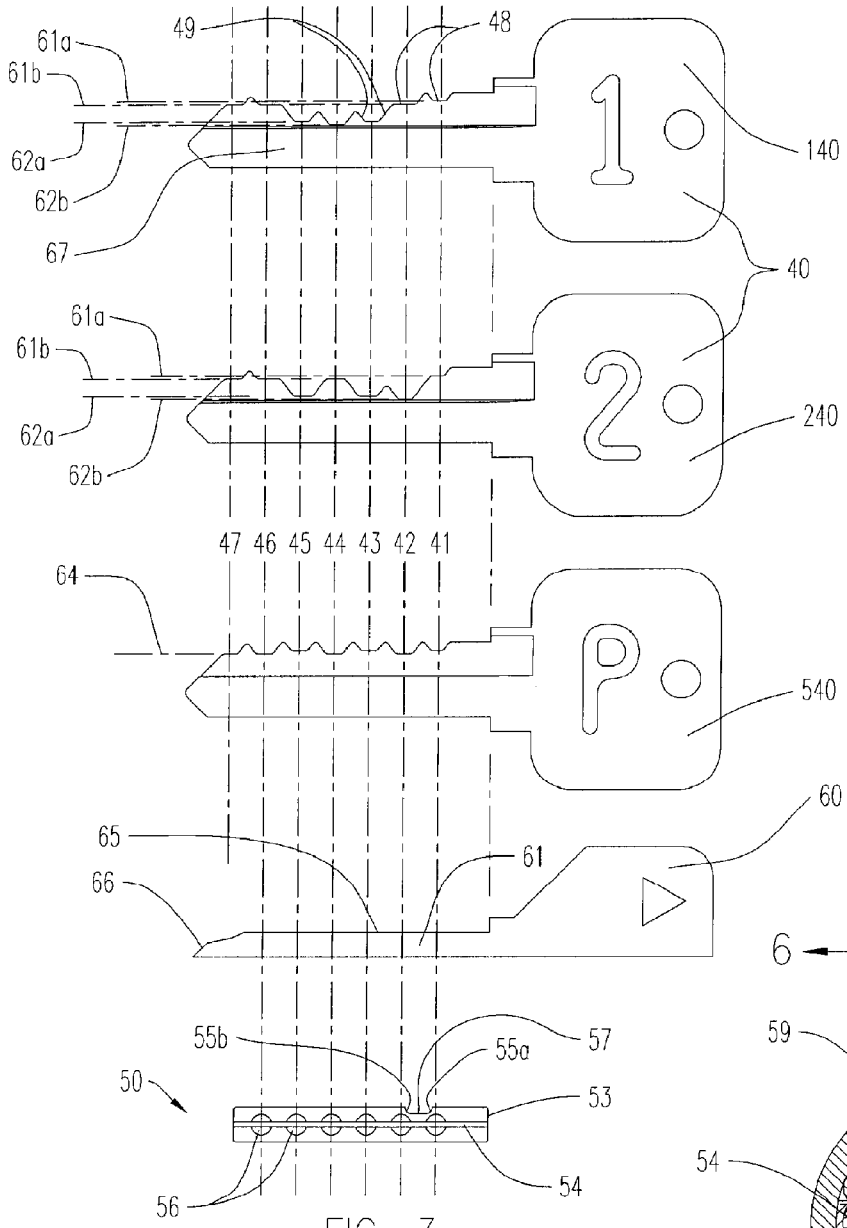
FIG. 3 shows a set of keys, a change tool and a cavity carriage employed in the programmable lock.
Figure 4:
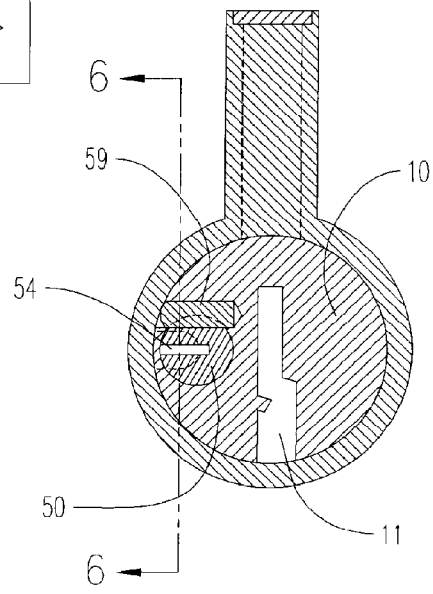
FIG. 4 shows a lateral sectional view of the cavity carriage through line 4-4 of FIG. 2.

The plug 10 has a keyway 11 which has been bored or machined out of the plug 10 to provide a passageway for an associated key 40, such as one of the keys shown in FIG. 3. Typically, the keyway 11 extends longitudinally from the front face 33 of the plug toward the rear. The cross sectional shape of the keyway 11 typically remains constant along the longitudinal axis 100 of the plug 12, and is configured to receive a corresponding shaft portion 67 of a key 40 that has a complementary cross sectional shape along its longitudinal length, as is well-known and practiced conventionally in the lock industry.

The plug 10 comprises a plurality of tumbler chambers 13 that penetrate from the plug periphery 12 through the body of the plug 10 to intersect the keyway 11. The tumbler chambers 13 lie generally in a plane that extends through the keyway 11. As shown in the illustrated embodiment, the tumbler chambers 13 are generally of the same diameter, and are equally spaced and aligned along the longitudinal length of the plug 10. Each tumbler chamber 13 is formed or machined along a centerline 300 that intersects and is perpendicular to the axial centerline 100 of the plug. When the tumbler chambers 13 of the plug 10 are axially aligned with the driver chambers 24 of the stack portion 22, the plug 10 is in a first rotated position with respect to the housing 20. The plurality of tumbler chambers 13 corresponding to pin chambers 1 through 7 may be denoted herein after as driver chambers 113, 213, 313, 413, 513, 613 and 713, respectively.

The latch or rear end of the plug can be provided with a means of securement, such as machined threads 31, which can extend from the end of the housing 20, and can receive a correspondingly-threaded cap 30 to secure the plug 10 within the housing 20. A latch 34 can be retained by the cap 30 for engaging a recess or bolt (not shown) to unlock the object, such as a door, padlock, etc., in which the cylinder lock is installed. A spring-loaded stop pin 37 that is secured to or within a bore in the rear end of the plug, engages a hole in the latch 34 to limit the rotation of the latch 34 relative to the plug. The latch can also be a lazy cam latch, and described in U.S. Pat. No. 7,290,418, the disclosure of which is incorporated herein by reference in its entirety.

The lock 1 also comprises a plurality of lock hardware elements, comprising a plurality of tumblers 25, drivers 27, driver springs 28, and at least one, or a plurality as shown, of change members 26. Typically, each pin chamber, formed from an aligned tumbler chamber 13 and corresponding axially aligned driver chamber 24 when the plug 10 is in its first or key insertion position, includes, in sequence, one tumbler 25, optionally a change member 26, one driver 27 and one driver spring 28. The tumblers 25 are generally pencil-shaped, consisting of a cylindrical body with a tapered or conical end. Each tumbler 25 is moveable axially along and within the tumbler chamber 13, and positioned with the tapered end extending into the keyway 11 when no key is inserted. The plurality of tumblers 25 corresponding to pin chambers 1 through 7 may be denoted herein after as tumblers 125, 225, 325, 425, 525, 625 and 725, respectively.

Each driver 27 is positioned within driver chamber 24 of the stack portion 22 of the housing, and is moveable axially along and within the driver chamber 24. The driver 27 typically has a cylindrical body. A driver spring 28 biases the driver 27 toward the inner surface 23 of the housing 20. The plurality of drivers 27 corresponding to pin chambers 1 through 7 are noted herein after as drivers 127, 227, 327, 427, 527, 627 and 727, respectively. The driver spring 28 is typically made of a tempered stainless steel to prevent material deformation upon multiple cycles of compression and extension. Preferably, the spring material is a non-metallic stainless steel wire of about size 008, and is available as part number C108x008x520 from W.B. Jones Spring Co., Inc., of Wilder, Ky. A planar lid 29 can be secured in position to the top of the stack portion 22 to retain the hardware elements after these have been loaded into the pin chambers.

The change member 26 is illustrated as a spherical ball. The spherical shape of the change member 26 allows rolling movement within the driver chambers 24, tumbler chambers 13, and other passageways in the lock, and projects the same cross-sectional shape (circular) regardless of its orientation. The spherical shape of the change member 26 eliminates corners or edges that can obstruct its free movement, and minimizes wear. A barrel- or cylindrical-shaped change member can be used in a lock of the present invention, although it may have a tendency to tilt or tumble within a chamber and against edges of the change slot, which can increase the potential of becoming lodged within the chamber and jamming the lock. For the purpose of describing succeeding embodiments of the present invention, the change member will hereinafter be referred to as the change ball 26.

As shown in FIGS. 1 and 2, the plug 10 has a plurality of openings 16 machined into the periphery 12 of the plug 10. The openings 16 are of substantially the same circular cross section, and are shown aligned along and disposed perpendicularly to the longitudinal axis of the plug. The plurality of openings 16 are equally spaced, whereby each opening 16 in the periphery 12 is axially aligned and circumferentially displaced from the tumbler chambers 13. Typically the diameter or minimum size of the opening 16 is larger than, and typically just slightly larger than, the diameter or maximum size of the change ball 26. The diameter of the opening 16 is smaller than, and typically slightly smaller than, the diameter of the corresponding driver pin.

A cavity carriage 50 is illustrated with a cylindrical shaped body 52 that is configured to be disposed and moveable within a cylindrical bore 19 formed in the plug 10. As illustrated, the bore 19 is formed in the face 33 of the plug, although in other embodiments, the bore opening can be formed in the rear end of the plug. Although the illustrated cavity carriage 50 and its complementary-shaped bore 19 are shown having a circular cross sectional shape, other shapes such as rectilinear and oval can be used in embodiments where the movement of the cavity carriage within the bore is axial. A captured spring 51 biases the axially moveable cavity carriage 50 forward toward the front of the plug. The bore 19 is formed parallel to the axis of the plug, and intersects the plurality of openings 16

The cavity carriage 50 is integral with the plug and lock assembly, and can not be separated or removed from the bore 19 without disassembling the plug 10 from the housing. The cavity carriage 50 also has a plurality of retainer cavities 56 formed into the surface and along its length. The retainer cavities 56 are substantially the same size, and are shown formed perpendicular to the longitudinal axis of the cavity carriage and having a circular cross section. The plurality of retainer cavities 56 are equally spaced, and has a pitch, or distance between adjacent retainer cavities, equivalent to the pitch of the driver chambers 24. The cavity carriage 50 moves within the bore 19 between a first position wherein the plurality of retainer cavities 56 are aligned axially with the corresponding plurality of driver chambers 24 when the plug 10 is rotated to the programming position, and a second position wherein the plurality of retainer cavities 56 are out of alignment with the plurality of driver chambers 24, and typically when the spring 51 has biased the cavity carriage 50 within the bore 19 toward the front 33 of the plug. The cavity carriage 50 can move axially between the first and second positions substantially independent of the position of the plug 10 within the housing 20.

Figure 5:
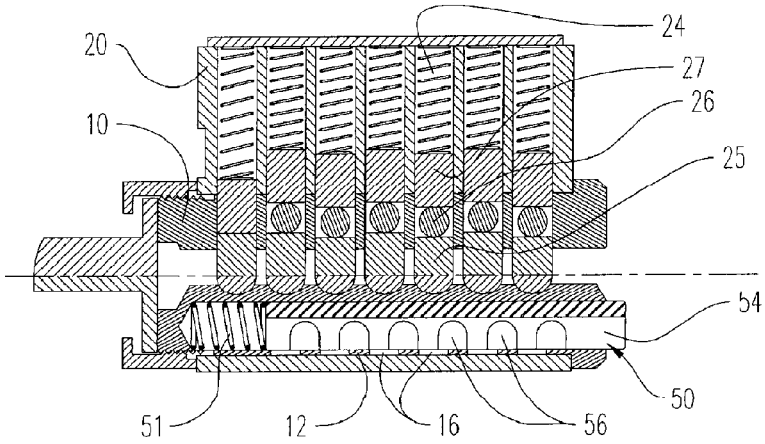
FIG. 5 shows a longitudinal sectional view of the programmable lock through line 5-5 of FIG. 2.
Figure 6:
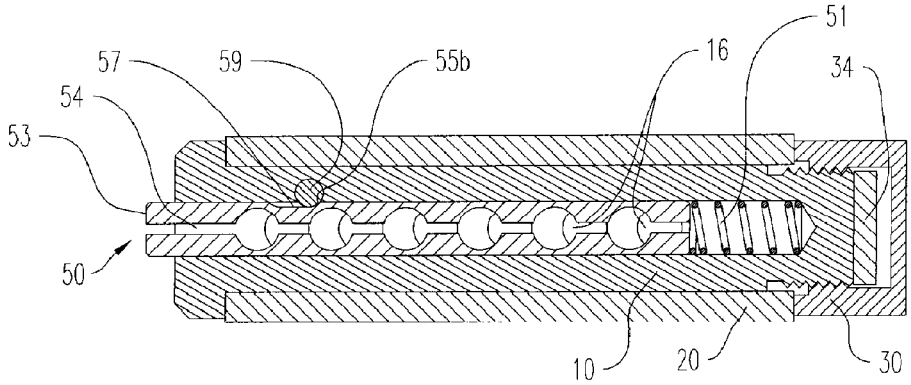
FIG. 6 shows a lateral sectional view of the programmable lock through line 6-6 of FIG. 2.

The cavity carriage 50 has an elongated flat or groove 57 formed in a proximal end of the cavity carriage 50, in a direction perpendicular to the longitudinal axis, and through the outer periphery of the carriage body as shown. The flat 57 is configured to receive a securing pin 58 that also passes through and is partially retained in a securing hole 59 formed in the periphery of the plug 10. The relationship between the securing pin 58 and the flat 57 is sliding, such that the portion of the securing pin 58 extending into the flat 57 restrains the cavity carriage 50 from rotation within the bore 19, and from longitudinal movement beyond a first stop position of the securing pin 58 against the first wall 55*a* of the flat 57, and beyond a second stop position of the securing pin 58 against the second wall 55*b* of the flat 57, as shown FIG. 6. FIG. 5 also illustrates the cavity carriage 50 having retainer cavities 56 that are not in axial alignment with the openings 16 or the driver chambers 24 when in its illustrated second position extending toward the front of the lock. One can see that pressing the cavity carriage rearward, which compresses spring 51, can bring the retainer cavities 56 into axial alignment with the openings 16 in the periphery 12 and the driver chambers 24.

The depth of the bore or cavity of the retainer cavity 56 formed into the cavity carriage 50 is at least as deep as, and typically slightly deeper than, the diameter or maximum size of the change ball 26. In a typical embodiment, the retainer cavities 56 comprise a means for preventing entry of the drivers 27 therein when the plug is in the programming position and the cavity carriage 50 is depressed into its first or communication position, which permits communication of the change ball between the driver chamber and the retainer cavity. The means for preventing entry of the drivers can comprise the retainer cavities 56 having an opening in the periphery of the cavity carriage 50 that is sized smaller than the drivers 27, to prevent a driver from dropping into an open retainer cavity 56 when in its communication position. More typically, and often concurrently, the opening 16 in the periphery of the plug 10 is likewise sized smaller than the drivers 27, to prevent a driver from dropping into an opening 16 when the plug is rotated to the programming position.

Also shown in FIGS. 1, 3, 4 and 6, the cavity carriage 50 has a change slot or groove 54 that is formed into the periphery of the cavity carriage 50, substantially parallel to the axial centerline. The change slot 54 extends from the front head or button end 53, toward and through one or more of the plurality of retainer cavities 56. The change slot 54 also extends through a portion of the plurality of retainer cavities 56. In the illustrated embodiment, the change slot 54 is formed through the centers of the aligned retainer cavities 56. Typically, the change slot 54 has a radial depth that is at least the same as or slightly more than the depth of the retainer cavities 56.

Figure 19:
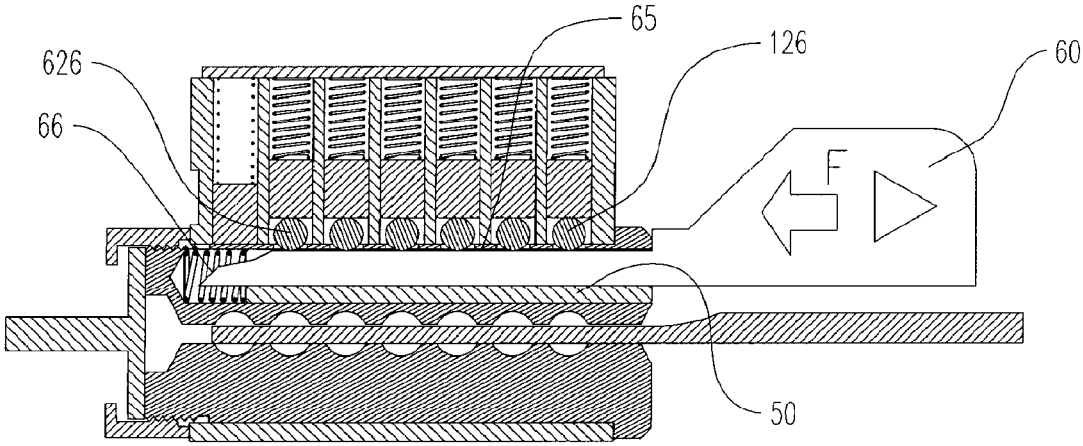
FIG. 19 shows the lock of FIG. 18 after the change tool has displaced change balls out of the cavity carriage.

The change slot 54 is configured to accommodate a blade 61 of a separate change tool 60 that is shown in FIGS. 1 and 3. The height of the blade 61 is configured so that the top 65 of the blade aligns proximate with, or slightly below, the periphery 12 of the plug when the blade 61 is inserted into the slot 54, as shown in FIG. 19. The configuration of the change slot 54 allows the inserted change tool 60 to be manipulated therein, to raise any and all change balls 26 contained within the retainer cavity 56 at its center of weight and to its maximum height relative to the retainer cavity 56. The blade 61 can have a linear upper edge extending along a portion that registers with some or all of the at least one retainer cavities when disposed in its second position fully inserted within the change slot 54. Alternatively, the blade can have a non-linear or curved upper edge, provided that each position along the edge that registers with all of the retainer cavities can raise the change ball, or member, to a position that allows it to be moved into the corresponding driver chamber. The change slot 54 is typically configured with a minimum width that accommodates the width of the blade 61, while maintaining effective lifting of the change balls 26. The width of the change slot 54 is typically about 0.020 inches (about 0.50 mm) or less. Typically the slot has a rectangular cross sectional shape.

The lock 1 is associated with a set of keys 40, a subset portion of which is illustrated in FIG. 3. The subset of keys 40 can include a first user key 140, a second user key 240, and a programming key 540. Each of the keys has a shaft portion 47 having a contour edge that comprises a plurality of contour landings 48 that define a plurality of contour positions. In the illustrated embodiment, the contour edge has one contour position corresponding to each of the pin chambers of the lock 1. Each contour landing 48 is generally flat and parallel with the axis of the key shaft 67. When any of the keys 40 are inserted fully into the keyway 11 of the plug 10, the contour positions 1 through 6, identified as contour positions 41, 42, 43, 44, 45, and 46, respectively, align with the pin chambers 1 through 6, respectively. The shaft 67 of a key 40 can be formed or machined to a specific depth at each contour position. The length of each contour landing 48 should be sufficiently long to prevent a tumbler 25 from beginning to descend or ascend prematurely off the end of the contour landing 48 when inserting or withdrawing the key 40 from the keyway 11. At the same time, the sloped transition portions 49 between adjacent contour landings 48 should be sufficiently shallow in slope to allow the plurality of positioned tumblers 25 to easily run up and down the length of the contour of a key 40 as the key is being inserted into or withdrawn from the keyway 11.

In the illustrated embodiment, the six contour positions 41, 42, 43, 44, 45, and 46 may be denoted herein after as 141, 142, 143, 144, 145, and 146, respectively, for the first user key 140;

as 241, 242, 243, 244, 245, and 246, respectively, for the second user key 240; and likewise for the programming key 540.

As is well known in the lock industry, the depth of a contour cut is typically made in relation with the height of the tumbler in the corresponding pin chamber. In the illustrated embodiments, the tumblers are shown having equal lengths (heights) in the tumbler chamber, to assist in illustrating the principals of the present invention. Typically, however, the heights of the various tumblers in the lock will vary, and therefore the corresponding contour cuts of the keys are cut to accommodate the tumbler lengths, as well as the height of the change member in the pin chamber.

In the present invention, as illustrated in the Figures, the depth of the cut (or said differently, the height) of the contour is also made in relation to the diameter or height of the change ball 26 associated therewith. That is, if a particular key is intended to raise a change ball 26 above the shear line 80 of the lock, then that key's corresponding contour position should be cut to a shallow depth (a raised contour) accordingly, which can raise at least the centerline of the change ball 26 above the shear line 80. In the illustrated embodiments, each user key 140 and 240 has a contour edge that can comprise one or more raised contours 61*a* and 61*b*, one or more lowered contours 62*a* and 62*b*, and typically a combination of raised and lowered contours. In the present invention, the height of a particular contour position for a user key, for example the first user key (140) or the second user key (240), will indicate the key's ability to raise a change ball 26 above the shear line 80 within that particular pin chamber. For example, the second contour position 142 of first user key 140 has a generally shallow cut (a raised contour position 61*b*), and the second contour position 242 of the second user key 240 has a generally deep cut (a lower contour position 62*b*). The shallow cut (raised contour 61*b*) of the second contour position 142 of user key 140 will allow key 140 to raise any change ball 226 in the second pin chamber 213 above the shear line 80 and into second driver chamber 224. Conversely, the generally deep cut (lower contour 62*b*) of the second contour position 42 on the second user key 240 will be insufficient to raise the change ball 226 out of the second tumbler chamber 213. Also, the generally deep cut in the fourth contour position 44 (lowered contour 62*b*) of the first user key 140 does not allow that key to raise a change ball 426 out of the fourth tumbler chamber 413, whereas the generally shallow cut in the fourth contour position 44 (raised contour 61*b*) of second user key 240 is sufficient to raise at least the centerline of the change ball 426, and typically the entire change ball, above the shear line 80 and into fourth driver chamber 424. These principles will be further illustrated in a description of the operation of the key herein after.

In the description above, it should be understood that a key configuration that allows a user key to raise a change member to above the shear line 80 also raises the top end of the tumbler 25 to proximate the shear line. This ensures that the change member is displaced into the driver chamber 24, and that no hardware member (specifically, neither the driver nor the tumbler) in the pin chamber spans the shear line at the key insertion position of the plug, particularly when the change member is in its second position in the retainer cavity, so that the plug can rotate within the housing to the operating position.

Figure 7:
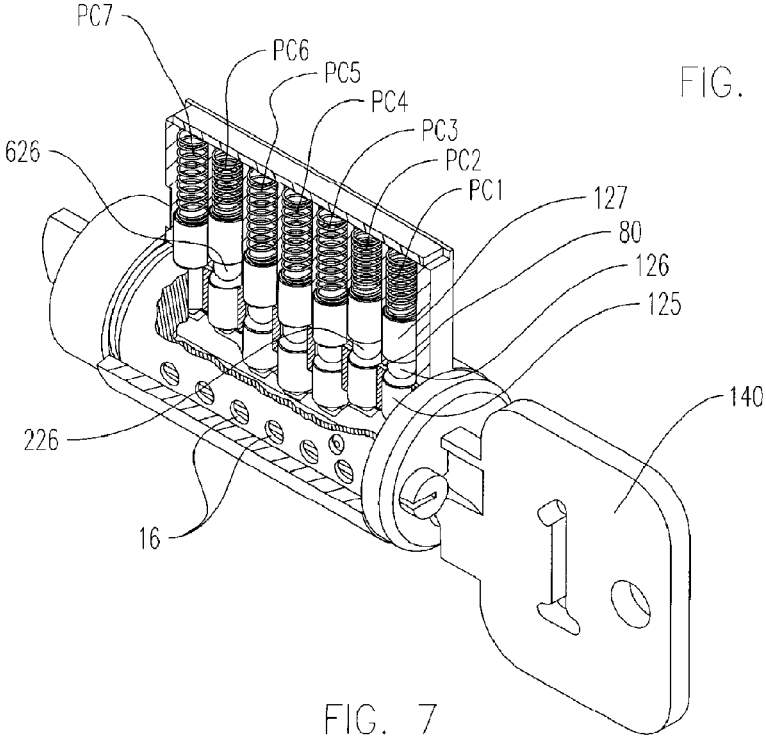
FIG. 7 shows the lock with a first user key inserted in the keyway.

The lock 1 shown in FIGS. 2 and 5 is in a null configuration, wherein each of the change balls 26 are disposed in their first positions in the corresponding first six pin chambers 1-6, designated as PC1, PC2, PC3, PC4, PC5, and PC6, respectively. A seventh pin chamber, PC7, includes only a driver and a tumbler. In each pin chamber, the change ball 56 resides between the tumbler 25 and the driver 27. While in the null position, a first user key 140 shown in FIG. 3 from a set of user keys is inserted as shown in FIG. 7. The raised contour positions 1, 2 and 6 of user key 140 raise the corresponding tumblers 125, 225, and 625 within the tumbler chambers, which in turn raise the corresponding change balls 126, 226 and 626 to a position where their centerlines are clearly above the shear line 80 and within corresponding driver chambers 124, 224 and 624. The remaining change balls 326, 426 and 526 have also been raised by their corresponding tumblers, but only to a height wherein they remain within their corresponding tumbler chambers 13.

Figure 8:
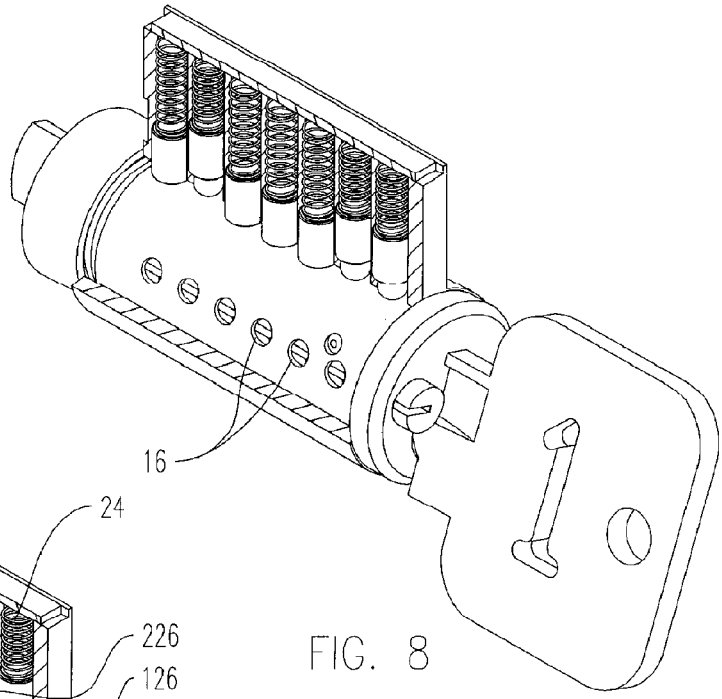
FIG. 8 shows the first user key partially rotating the plug in the lock.
Figure 9:
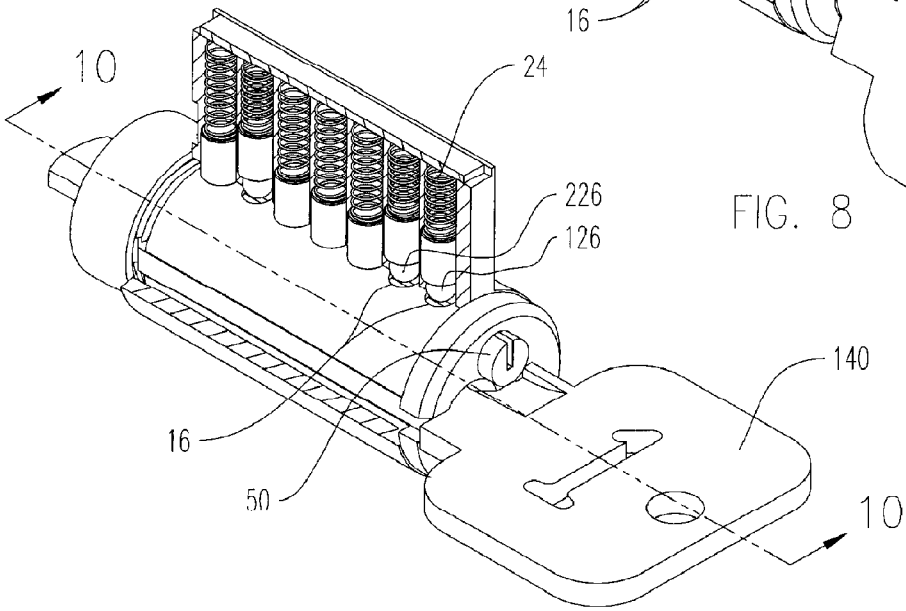
FIG. 9 shows the first user key rotating the lock to a programming position.

It can be observed that none of the hardware (drivers 27, tumblers 25 or change members 26) span across the shear line 80 of any of the pin chambers. Thus, as the key 140 starts rotating the plug into a first direction (clockwise, looking at the front of the lock) as shown in FIG. 8, change balls 126, 226 and 626, become isolated within the corresponding driver chambers 24, while change balls 326, 426, and 526 remain within their corresponding tumbler chambers and rotate with the plug 10. When the rotating plug 10 arrives at the programming position shown in FIGS. 9 and 10, the driver chambers 24 have aligned with the opening 16 in the periphery of the plug.

Figure 10:
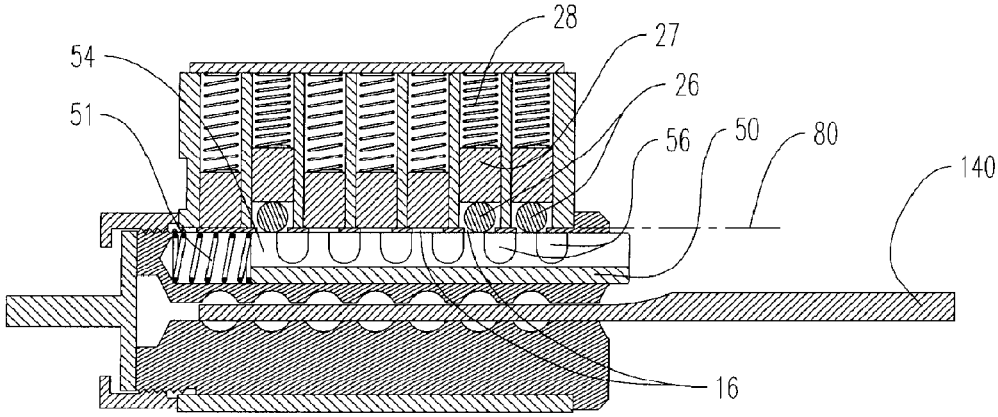
FIG. 10 shows a sectional view of the lock taken through line 10-10 in FIG. 9.
Figure 11:
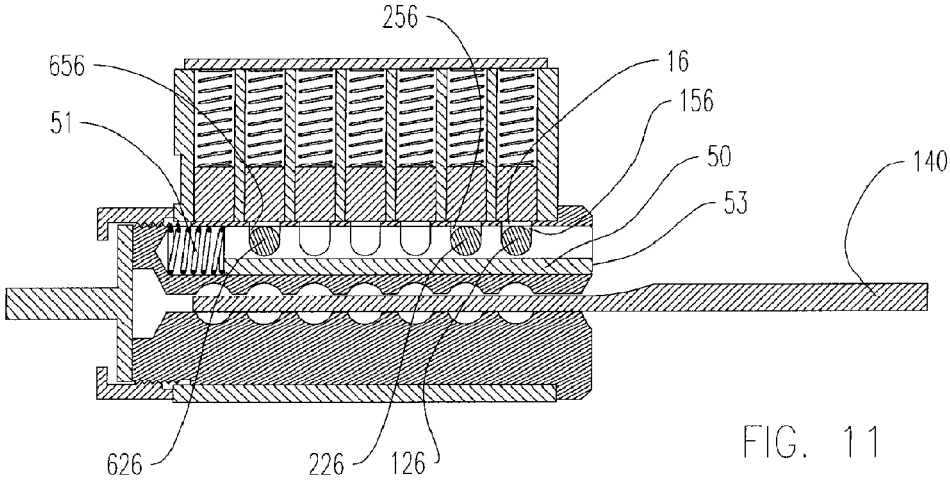
FIG. 11 shows the lock shown in FIG. 10 after depressing inward the cavity carriage.

As shown in FIG. 10, disposed below the openings 16 in the plug is the cylindrical body 52 of the cavity carriage 50. Each change ball 126, 226 and 626 is biased by their corresponding drivers 27 and driver springs 28 against the outer surface of the cylindrical body 52 along the opening of the slot 54, and between the openings to the retainer cavities 56. As long as the cavity carriage 50 remains in the second position, biased forward by the spring 51, communication of the change ball 26 between the driver chamber 24 and the retainer cavity 56 is prevented. That is, the change ball can not move from the driver chamber into the retainer cavity. However, as soon as the cavity carriage 50 is forced rearward against the biasing spring 51, such as by depressing end 53, the plurality of retainer cavities 56 align axially with the openings 16 in the plug periphery and with the driver chambers 24, to allow the change balls 126, 226 and 626 to move by the force of the driver springs 28 into the corresponding retainer cavities 156, 256 and 656, as shown in FIG. 11.

When the first key 140 is used to rotate the plug back to the key insertion position, and key is removed, the lock is then said to be configured for the first user key, with change balls 126, 226 and 626 disposed in their second positions within the corresponding retainer cavities, and change balls 326, 426 and 526 disposed in the corresponding pin chambers. Consequently, change balls disposed in the driver chambers when the plug is in the programming position, can only be moved into the retainer cavities by movement of the cavity carriage 50 into its first, aligned position.

The lock illustrated can be reprogrammed to operate with a different user key by changing the arrangement of change balls between the pin chambers and retainer cavities. In the illustrated embodiment, a programming key 540 is used to rearrange the positioning of the change balls 26 between the several pin chambers PC1-PC6 and the several retainer cavities 156 through 656. It will also be apparent that the same first user key 140 can be used to reprogram the lock, in place of the programming key, whenever the lock is configured for operation with the first user key (meaning, the first user key can not be used to operate the lock, or to reprogram the lock, when the lock is configured for operation with the second user key 240 or any other user key.)

Figure 12:
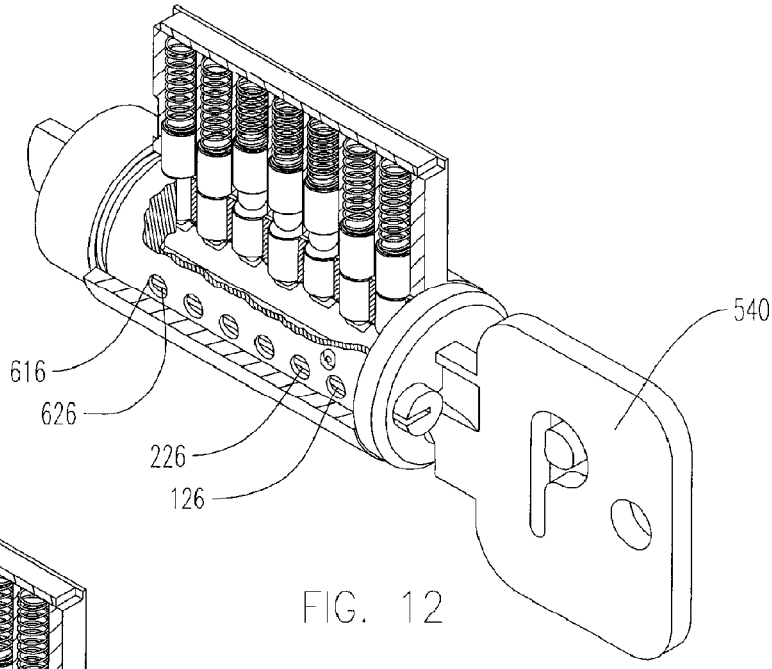
FIG. 12 shows the lock returned to the key insertion position, with the first user key removed, and a programming key inserted into the keyway.
Figure 13:
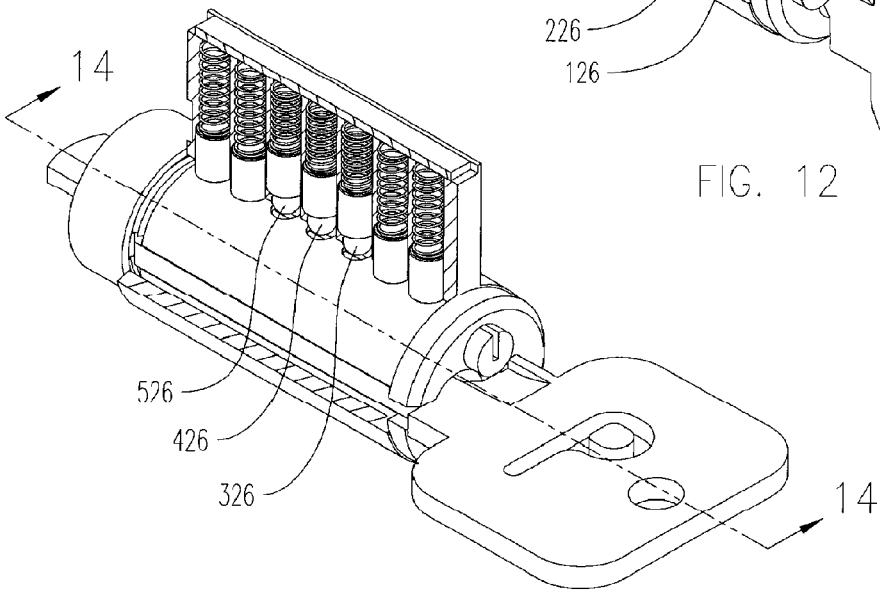
FIG. 13 shows the programming key rotating the plug to the programming position.
Figure 14:
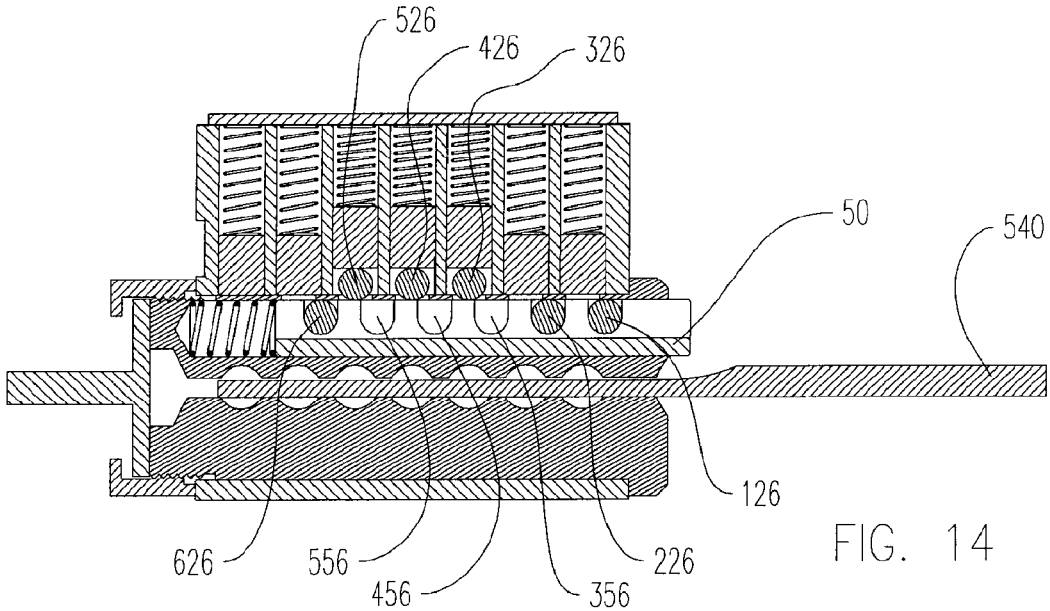
FIG. 14 shows a sectional view of the lock taken through line 14-14 in FIG. 13.

Referring to FIGS. 12 through 23, the lock 1 is programmed to operate with the first user key 140, since the change balls from the $1^{st}$, $2^{nd}$ and $6^{th}$ pin positions correspond with raised contour positions 41, 42 and 46 on first user key 140. When programming key 540 is inserted into the keyway as shown in FIG. 12, the programming contour positions 64 (see FIG. 3) across each and all of the contour positions of the programming key causes all the change balls 326, 426 and 526 disposed in the corresponding pin chambers to be raised out of the tumbler chambers 13 and substantially into the driver chambers 24. It can be observed that none of the hardware (drivers 27, tumblers 25 or change members 26) span across the shear line 80 of any of the pin chambers. Thus, when the programming key 540 rotates the plug to the programming position shown in FIG. 13, the change balls 326, 426 and 526 become isolated within the corresponding driver chambers 24. When the rotating plug 10 arrives at the programming position shown in FIGS. 13 and 14, the change balls 126, 226 and 626 are disposed in the respective retainer cavities 56, and the change balls 326, 426 and 526 disposed in the driver chamber 24 and isolated from the retainer cavities 56 by the cavity carriage 50 in its non-aligned position.

Figure 15:
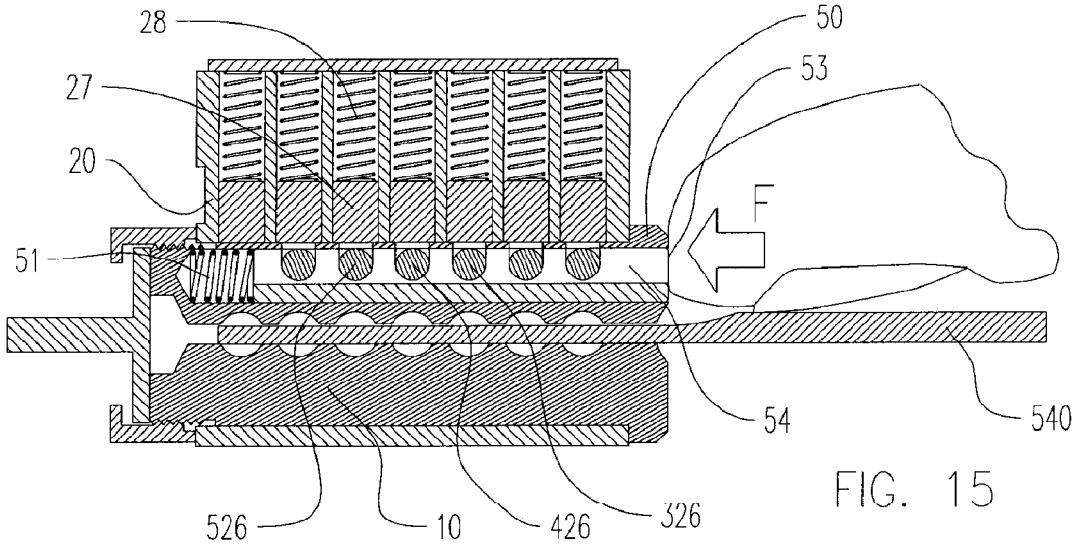
FIG. 15 shows the lock of FIG. 14 after depressing inward the cavity carriage, to deposit change balls into the cavity carriage.

When employing a programming key to reprogram the lock, the lock is typically first placed into a reset position, by moving all of the change balls into their corresponding retainer cavities 56. As shown in FIG. 15, this is accomplished by manipulating the cavity carriage 50, typically by depressing the end 53 rearward against the biasing spring 51, to place the cavity carriage into its first, aligned position, and each of the retainer cavities into alignment and communication with the corresponding driver chambers. In this position, the remaining change balls 326, 426 and 526 are forced by driver springs 28 down into the retainer cavities 356, 456 and 556.

Figure 16:
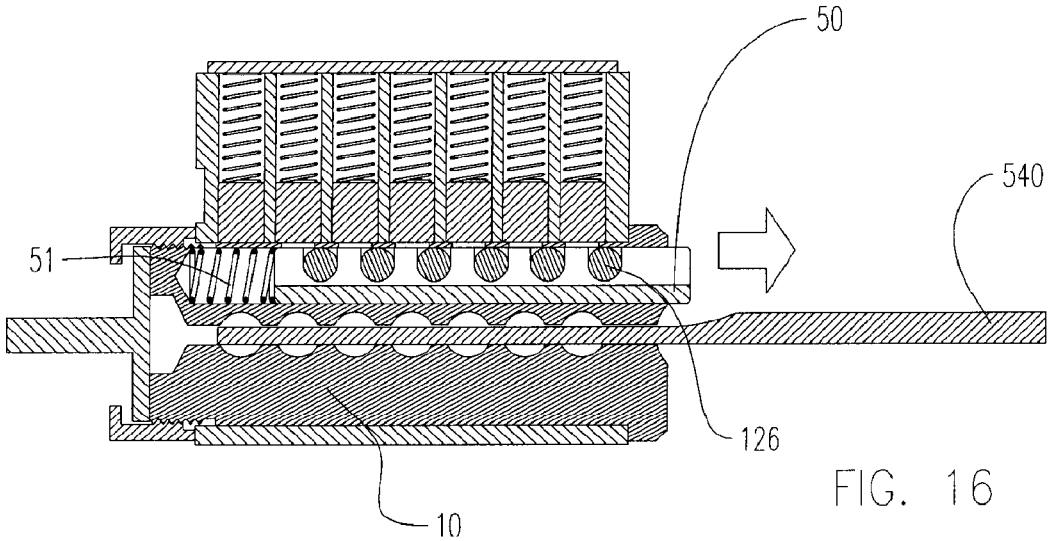
FIG. 16 shows the lock of FIG. 15 after the cavity carriage is released outward.

When the cavity carriage is released back to its biased second, non-aligned position shown in FIG. 16, the lock is said to be in a "lockout" configuration. If the programming key 540 were to be removed in this configuration, then none of the authorized user keys of the set of keys would be able to operate the lock, because each of the user keys has at least one contour position that is a lowered contour position. Use of that user key when the lock is in the lock-out configuration will fail to raise the drive corresponding to that lowered contour position to a height sufficient to align with the shear line 80. Rather, that driver will span across the shear line, and the plug will not rotate, and hence the lock will not operate.

Figure 17:
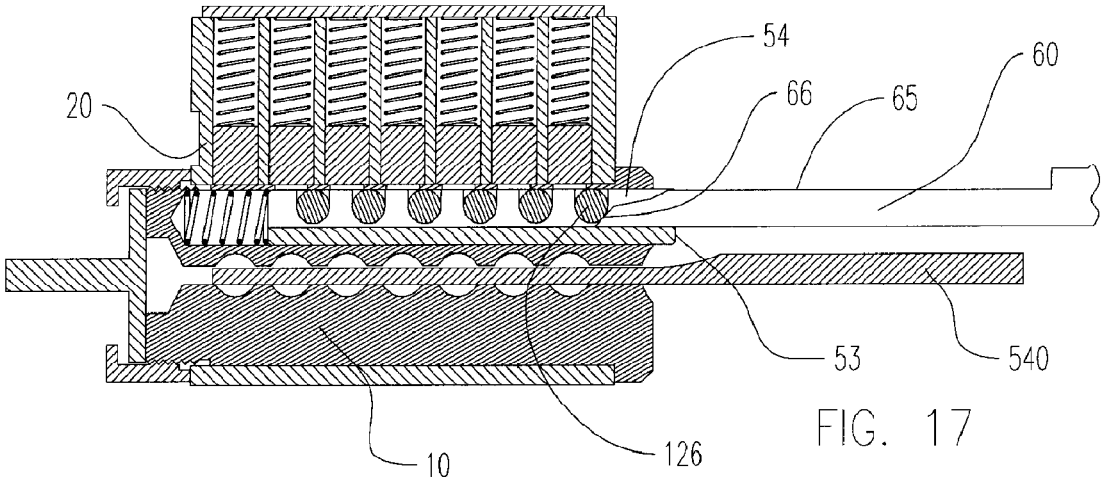
FIG. 17 shows the lock of FIG. 16 upon initial engaging of a change tool into the slot of the cavity carriage.
Figure 18:
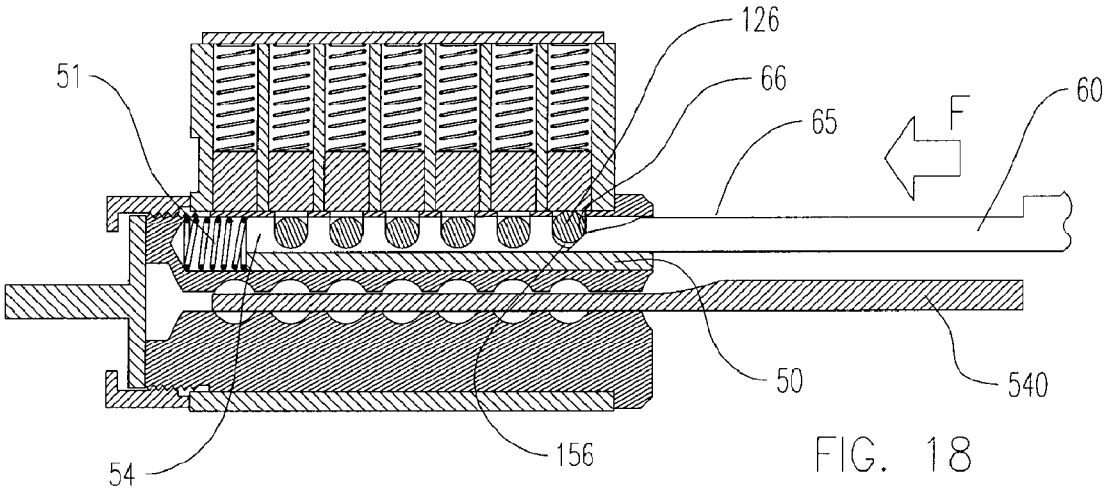
FIG. 18 shows the lock of FIG. 17 after the change tool has moved the cavity carriage inward.
Figure 20:
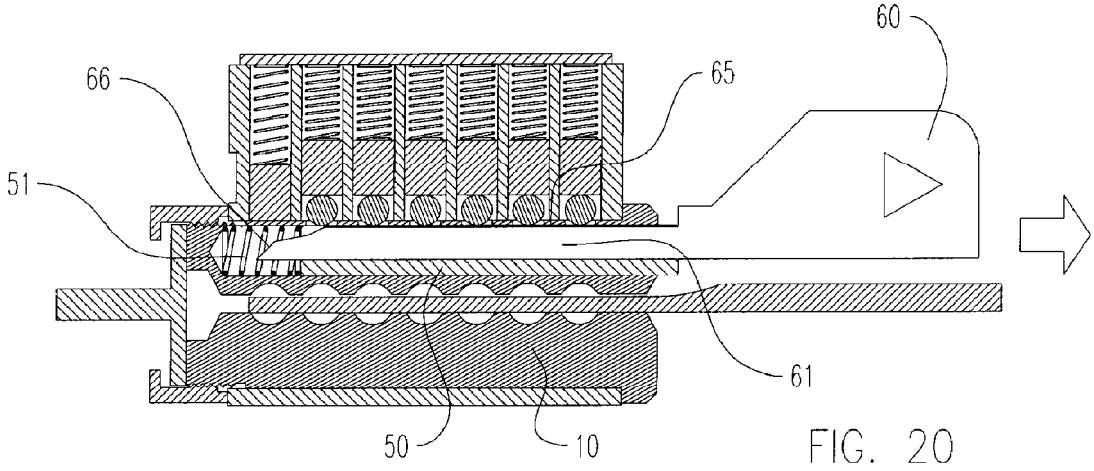
FIG. 20 shows the lock of FIG. 19 after the change tool and cavity carriage are released outward.
Figure 21:
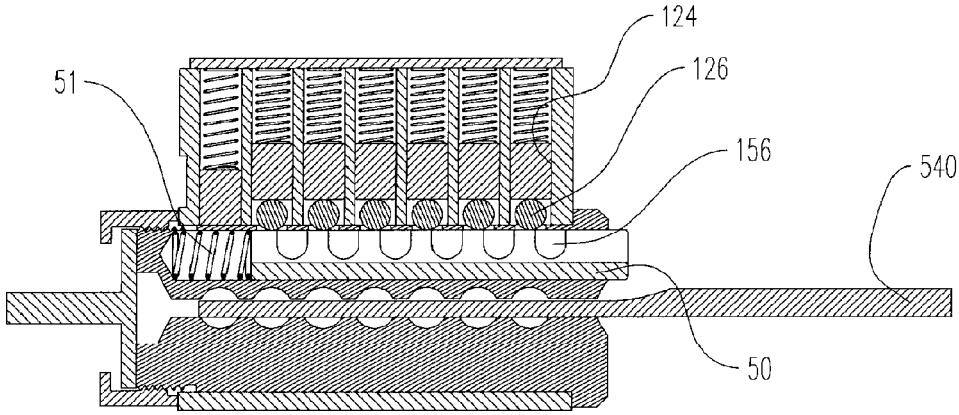
FIG. 21 shows the lock of FIG. 20 after the change tool has been removed from the cavity carriage.

From the lockout configuration shown in FIG. 16, the lock can be temporarily returned to the null configuration, mentioned previously and shown in FIG. 2. This is accomplished by bringing the cavity carriage 50 into its first alignment position with respect to the driver chambers 24, and using a change tool 60, also shown in FIG. 3, to raise each and all of the change balls 26 to a position where at least their centerlines are displaced out of their corresponding retainer cavities 56 and into the driver chambers 24. In FIG. 17, the tip 66 of the change tool 60 is placed into the slot 54 at the end 53. The tip 66 is shown having a first leading beveled portion and a second trailing beveled portion, configured to raise a change member a first axial distance and a second axial, respectively, within the retainer cavity. The leading beveled portion has a somewhat blunted profile, to transfer longitudinal force from the change tool into both longitudinal and vertical (lifting) force vectors upon the curved surface of the change ball or other change member. As the change tool 60 is manipulated rearwardly, the leading bevel portion of the tip 66 first engages change ball 126 disposed in its retainer cavity 156, and the vertical or lifting force vector partially raises the change ball within retainer cavity against the inside wall of the cylindrical bore 19, while the longitudinal force vector acts upon the change ball 50 within the retainer cavity to move the cavity carriage 50 longitudinally in the rearward direction, against the biasing force of the spring 51, until the cavity carriage 50 arrives at its first, aligned position with respect to the driver chambers shown in FIG. 18. Typically, a stop means, such as the pin 59 in groove 57 of cavity carriage 50, can be provided to prevent the cavity carriage 50 from moving further rearward beyond the aligned position. Once the cavity carriage has engaged the stop means, further manipulation of the change tool 60 into the length of the slot 54 forces the tip 66 followed by the blade 51 to both be inserted into and to occupy the space within each and all of the retainer cavities 56, and to scoop and lift each and all of the change balls 26, in succession, up and onto the top edge 65 of the change tool 60. The height of the top edge 65 raises each and all of the change balls 26 to a height where at least the centerline of the ball is raised into the corresponding driver chamber 24, as shown in FIG. 19. With the change tool 60 fully inserted into the slot 54 and occupying the space within each retainer cavity 56, the manipulation and rearward force applied to the change tool 60 can be released, whereby the biasing spring 51 forces the cavity carriage 50 with the inserted change tool 60 to its non-aligned position, as shown in FIG. 20. In this position, as shown in FIGS. 21 and 22, the change tool 60 can be withdrawn, whereby the change balls 26 remain isolated in the driver chambers from the retainer cavities 56, since the cavity carriage 50 is in its non-aligned position and the change balls 26 rest in the openings 16 of the plug and upon the peripheral surface of the cavity carriage 50 disposed between the adjacent retainer cavities 56.

Figure 22:
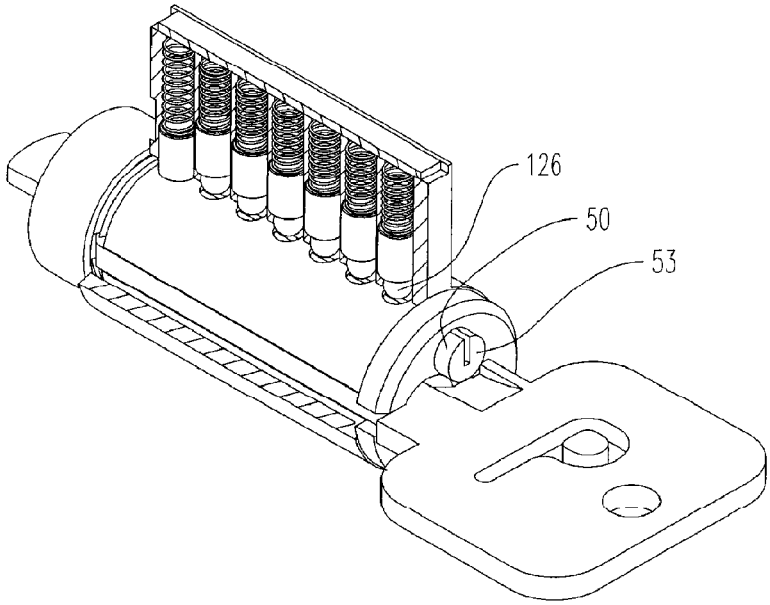
FIG. 22 shows the lock of FIG. 21 in perspective view.

It can be understood, viewing FIG. 22, that if the user were to depress the button end 53, the cavity carriage 50 would be manipulated axially into its first, aligned position, and all of the change balls 26 would move back into their corresponding retainer cavities 56.

Figure 23:
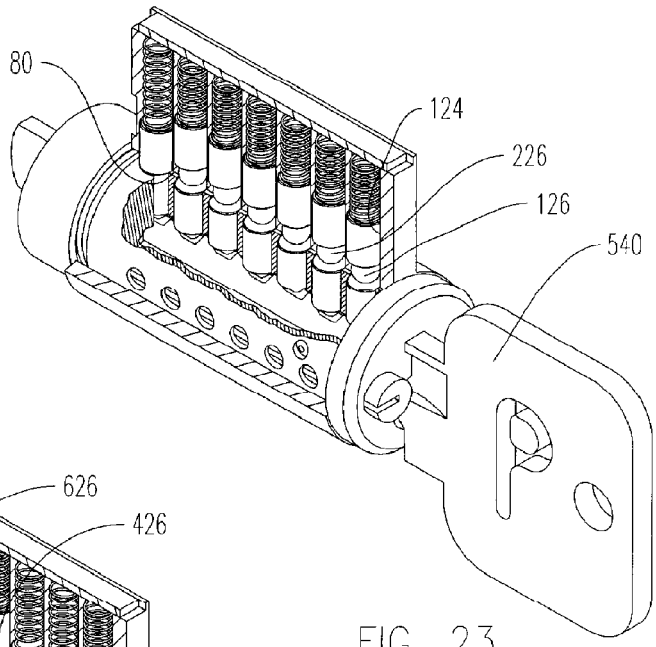
FIG. 23 shows the lock of FIG. 22 after the programming key has rotated the lock to the key insertion position.

To reprogram the lock for use with a second user key, the plug is rotated back to the key insertion position shown in FIG. 23, placing all the change balls 26 back into their corresponding pin chambers. Upon removal of the programming key 540, the lock now has been returned to the null position, with all the change balls 26 back into their corresponding pin and tumbler chambers, as shown in FIG. 2.

Figure 24:
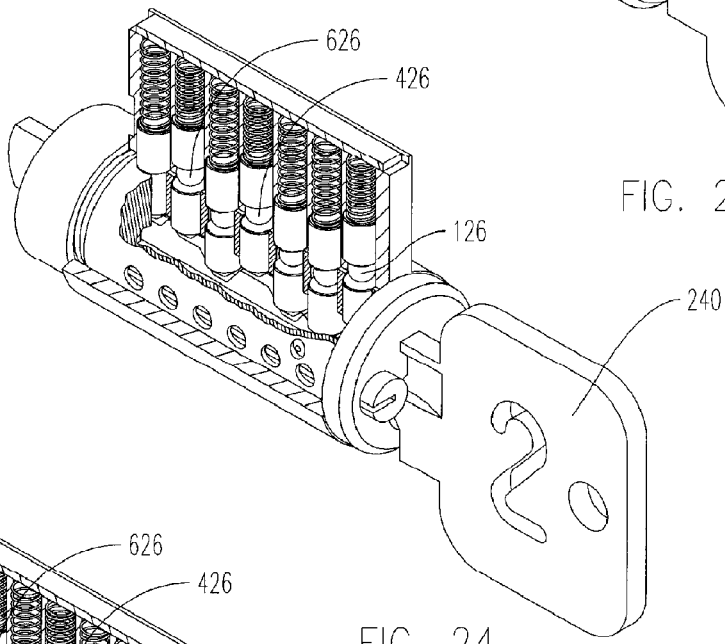
FIG. 24 shows the lock of FIG. 23 with the programming key withdrawn, and a second user key inserted.
Figure 25:
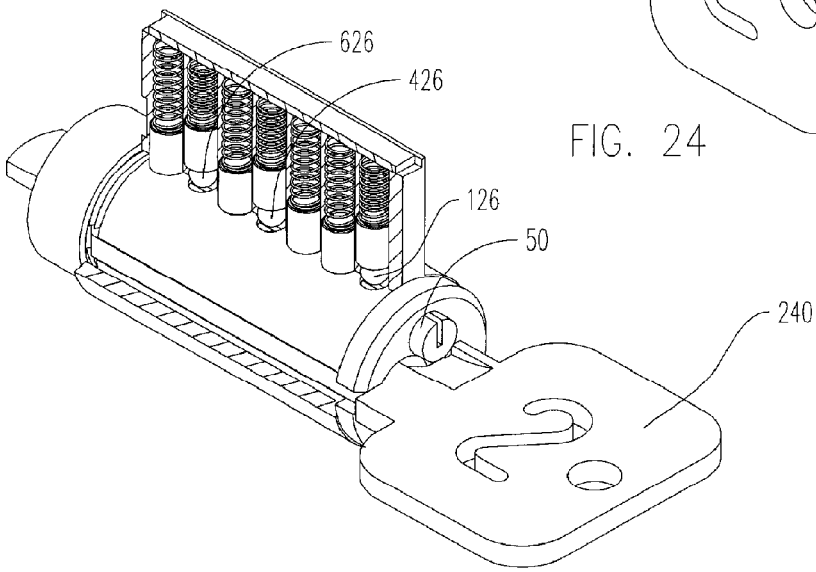
FIG. 25 shows the lock of FIG. 24 where the second user key has rotated the plug to the programming position.
Figure 26:
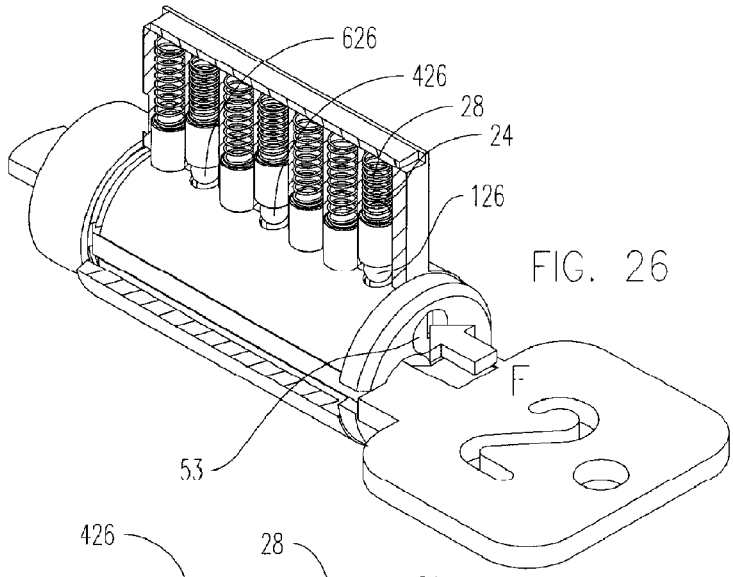
FIG. 26 show the lock of FIG. 25 after depressing inward the cavity carriage, just before certain change balls drop into the cavity carriage.
Figure 27:
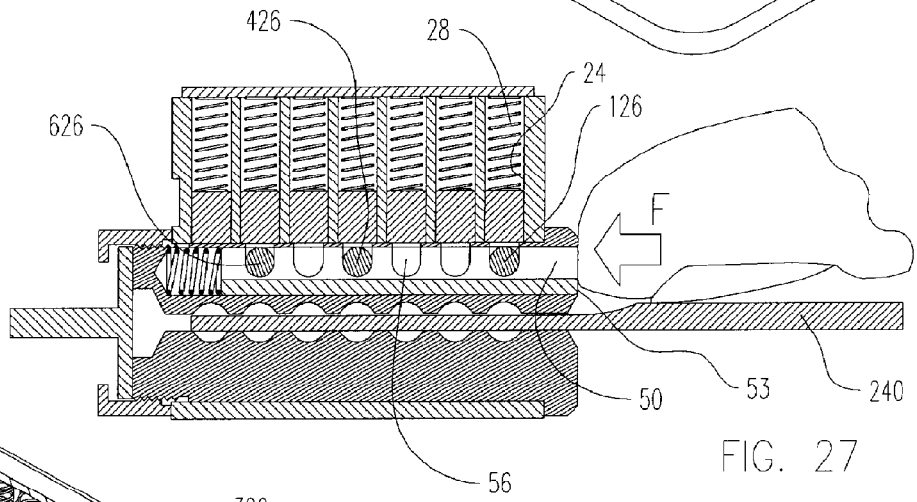
FIG. 27 shows a sectional view of the lock of FIG. 26, after the change balls have dropped into the cavity carriage.

From the null lock configuration, any of the authorized user keys of the set of keys including the first user key 140 (again) and second user key 240 can be inserted into the lock and manipulated to the programming position to reconfigure the lock for that particular user key. FIGS. 24-28 show the steps for configuring the lock from the null configuration, where either user key can be inserted and the plug rotated, to a configuration for operation by the second user 240 key, wherein the first key 140 can not operate the lock. In FIG. 24, the raised contour positions on user key 240 raise the change balls in the first, fourth and sixth pin chambers into the corresponding driver chambers, where they are isolated when the plug 10 is rotated to the programming position shown in FIG. 25. The change balls 126, 426 and 626 remain in the driver chambers because the cavity carriage 50 is biased to its non-aligned position within the plug. Upon manipulation of the button 53 rearward, as shown in FIG. 26, the retainer cavities 56 align with the driver chambers 24, and the force of the driver springs 28 move the change balls 126, 426 and 626 into the corresponding retainer cavities of the cavity carriage 50, as shown in FIG. 27. The change balls 126, 426 and 626 can be isolated into their corresponding retainer cavities 156, 456 and 656 either by releasing the force on the cavity carriage 50 to allow movement to its non-aligned position, or by rotating the plug back to the key insertion position, shown in FIG. 28, while depressing the end 53. Once returned to the key insertion position, the lock is then said to be configured for the second user key 240, with change balls 126, 426 and 626 disposed in their second positions within the corresponding retainer cavities, and change balls 226, 326 and 526 disposed in the corresponding pin chambers.

A second embodiment of the lock is shown in FIGS. 29-34. The embodiment is otherwise the same as the first embodiment, except that the cavity carriage 150 of the second embodiment moves within the bore 19 in rotational movement, instead of the axial movement of the first embodiment. The cavity carriage 150, shown in FIG. 29, has a cylindrical shaped body 152 that is configured to be disposed and moveable rotationally within a cylindrical bore 19 formed in the plug 10. The cavity carriage 150 has a plurality of retainer cavities 156 formed into the surface of the cavity carriage and along its length and a slot 154, similar to those described for the first embodiment of cavity carriage 50. The cavity carriage 150 rotates within the bore 19 between a first position, shown in FIGS. 30 and 33, wherein the plurality of retainer cavities 156 are aligned axially with the corresponding plurality of driver chambers 24 when the plug 10 is rotated to the programming position, and a second position, shown in FIGS. 31 and 32, wherein the corresponding plurality of retainer cavities 156 are not aligned with the plurality of driver chambers 24, typically wherein the openings into the retainer cavities face or are oriented within the body of the plug 10. Alignment of the retainer cavities and the driver chambers typically means that the openings register to permit movement of the change ball therebetween. When not in alignment, the central axes of the respective driver chambers and retainer cavities are typically non-parallel, and the respective openings of the retainer cavities are not coextensive with the driver chamber.

The cavity carriage 150 has a rounded groove 157 formed in the outer periphery of the cavity carriage 150, extending radially about 90° around the circumference of the carriage 150. The groove 157 is configured to receive the securing pin 58, shown in FIG. 29, that passes through and is partially retained in a securing hole 59 formed in the plug 10. The relationship between the securing pin 58 and the groove 157 is sliding, such that the portion of the securing pin 58 residing within the groove 157 restrains the cavity carriage 150 from longitudinal movement within the bore 19, while permitting rotation of the carriage 150 within the bore 19 in a range of about 90°.

Figure 29:
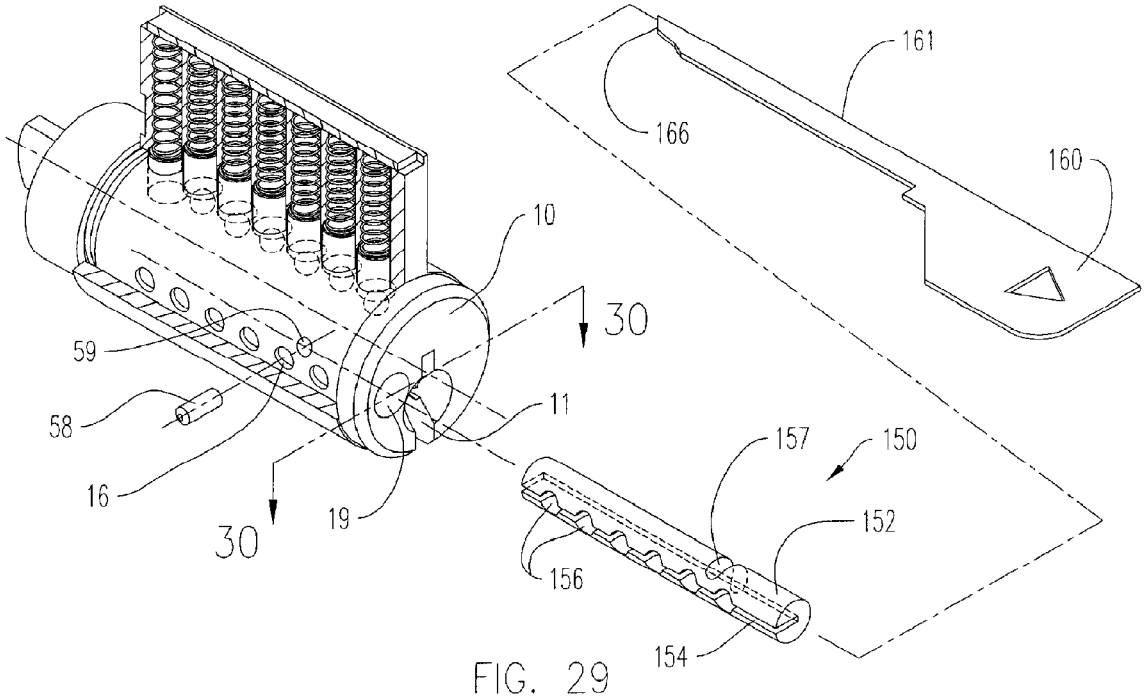
FIG. 29 shows the lock with a second embodiment of a cavity carriage.
Figure 30:
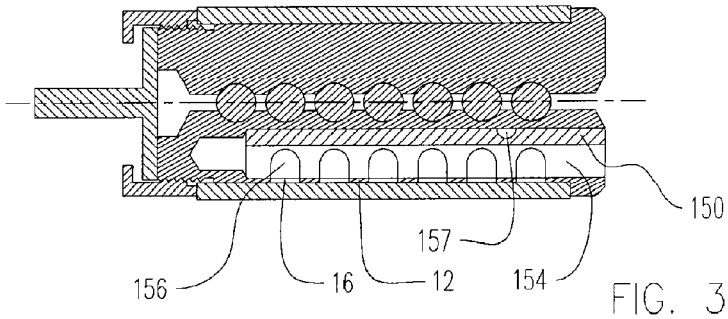
FIG. 30 shows a horizontal sectional view of the cavity carriage through line 30-30 of FIG. 29.
Figure 31:
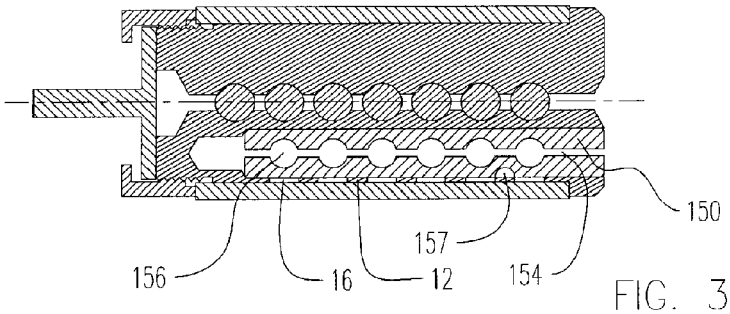
FIG. 31 shows the lock of FIG. 30, with the cavity carriage rotated to a second position.
Figure 32:
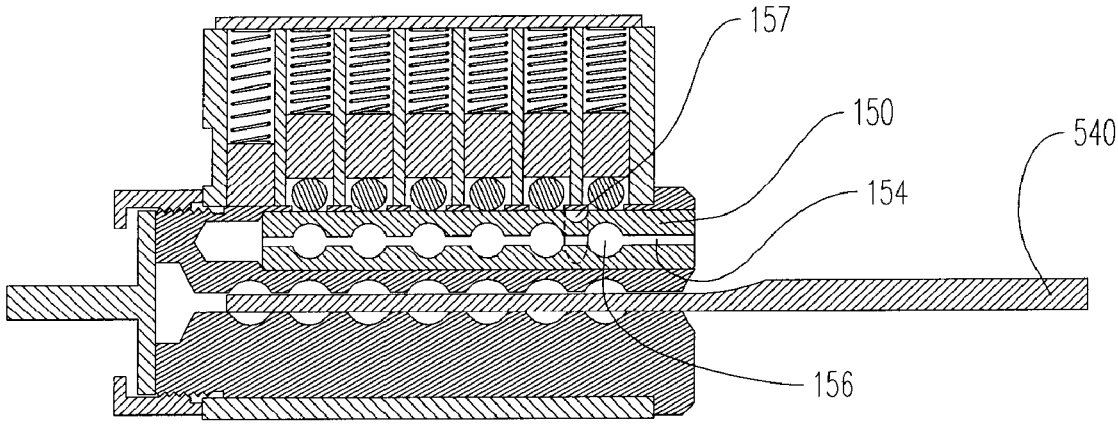
FIG. 32 shows a vertical sectional view of the lock of FIG. 31, with the programming key inserted and the plug rotated to the programming position.
Figure 33:
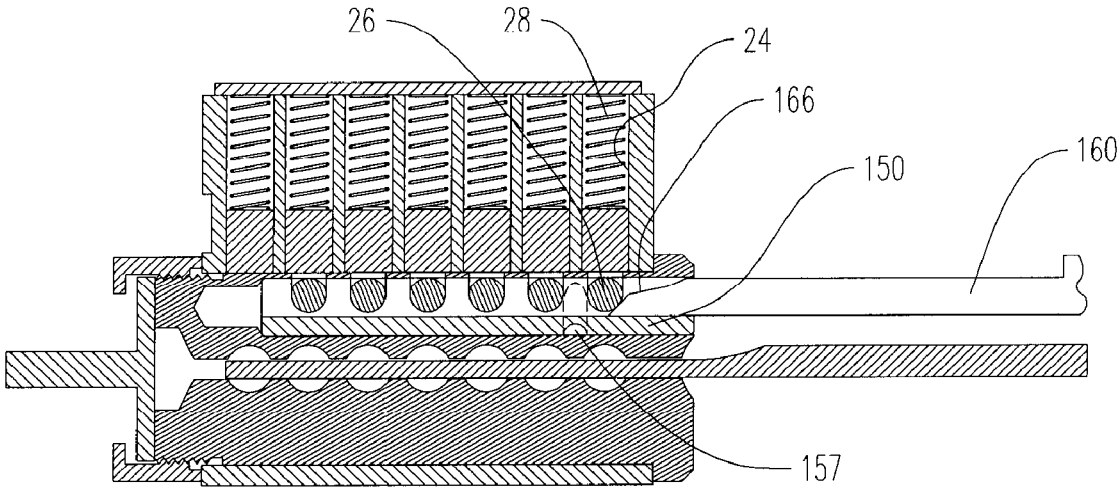
FIG. 33 shows the lock of FIG. 32 with the change tool inserted partly into the slot and the cavity carriage rotated to the first position.
Figure 34:
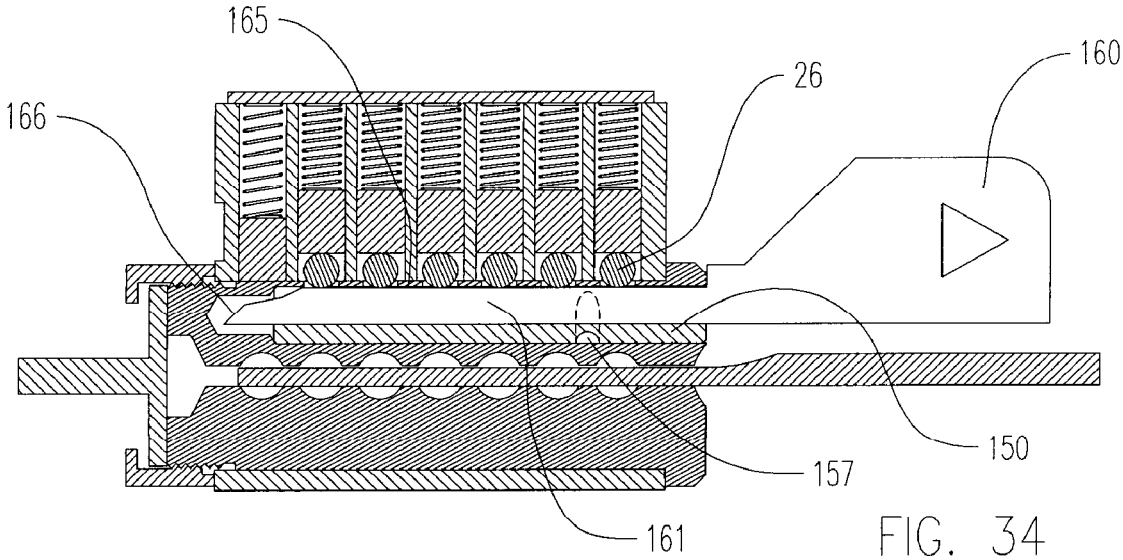
FIG. 34 shows the lock of FIG. 33 after the change tool has displaced change balls out of the cavity carriage.
Figure 35:
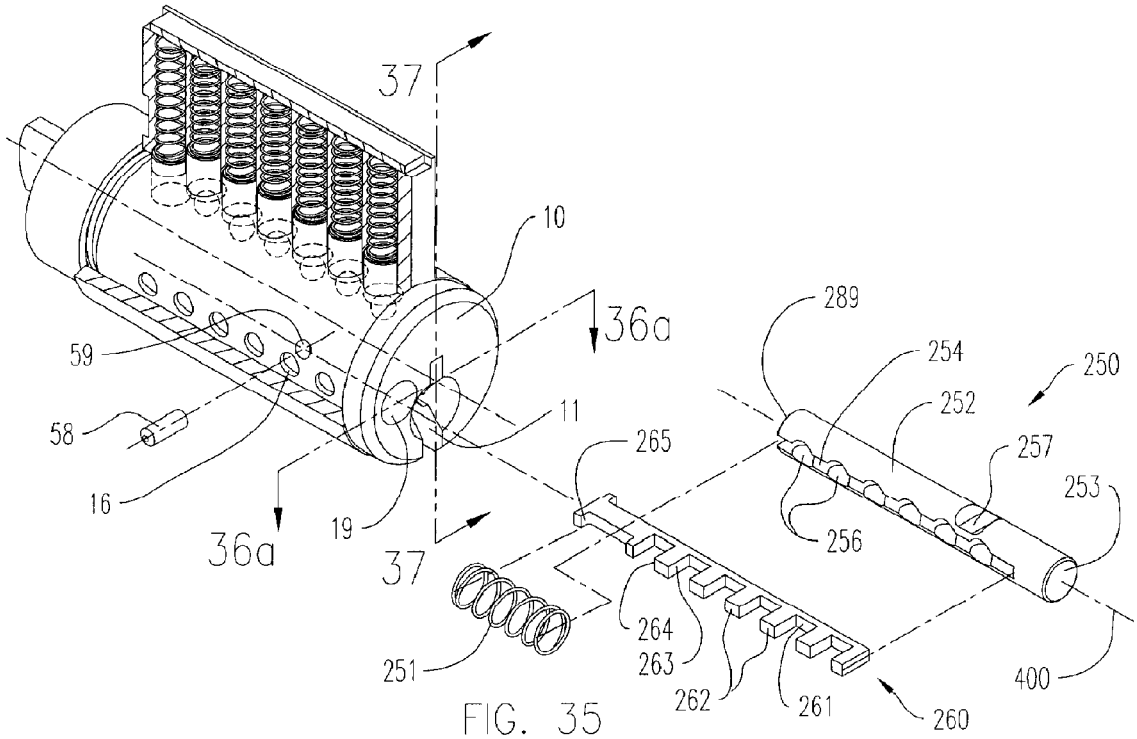
FIG. 35 shows the lock with a third embodiment of a cavity carriage

FIG. 30 is a sectional view of the lock of FIG. 29, taken through the cavity carriage 150, showing the cavity carriage 150 rotated in a position where the retainer cavities 56 are in axial alignment with the openings 16 in the periphery of the plug 10. FIGS. 31 and 32 show the cavity carriage 150 within the bore 19 rotated to its second, non-aligned position, with the slot 154 oriented perpendicular to or away from the axis of the opening 16 in the plug periphery 12. FIG. 32 also shows the lock in a configuration wherein the programming key 540 has been inserted and rotated in the plug when all of the change balls 26 were originally in the corresponding pin chambers. FIG. 33 shows the lock just after the cavity carriage 150 has been rotated within the bore 19 to its second or aligned position, wherein each of the retainer cavities 156 are aligned with and open to receiving the change balls 26 that are driven down out of the driver chambers 24 by the driver springs 28, placing the lock into the reset configuration. The opening of the slot 154 in the end 153 serves as a convenient opening into which the tip 166 of the change tool 160, or some other wedge means, can be inserted as a lever to rotate the cavity carriage 150 to the first communication position. Typically, the groove 157 and pin 58 cooperate so that the rotation to the communication position stops when the slot 54 is oriented parallel to the opening 16 in the plug periphery 12.

FIG. 33 also illustrates the step of raising any of the change balls 26 from the retainer cavity 156 into the corresponding driver chamber 24. The tip 166 of the change tool 160 is inserted into the end of the slot 154, and then manipulated, as previously described for the first embodiment, to successively raise each of the change balls 26 out of the retainer cavities 156 as the change tool blade 161 is moved into and through each successive retainer cavity 156 along the length of the slot 154. From this position, the change balls 26 can be isolated into the driver chambers 24 by moving the retainer cavities 156 out of alignment with the driver chambers 24, either by rotating the plug 10 away from the programming position, or by manipulating the change tool 160 to rotate the cavity carriage 150 within the bore 19 away from the opening 16 in the plug periphery, as shown in FIG. 31. As explained earlier, movement of the change balls 26 back to the pin chambers places the lock back into a null configuration.

Figure 28:
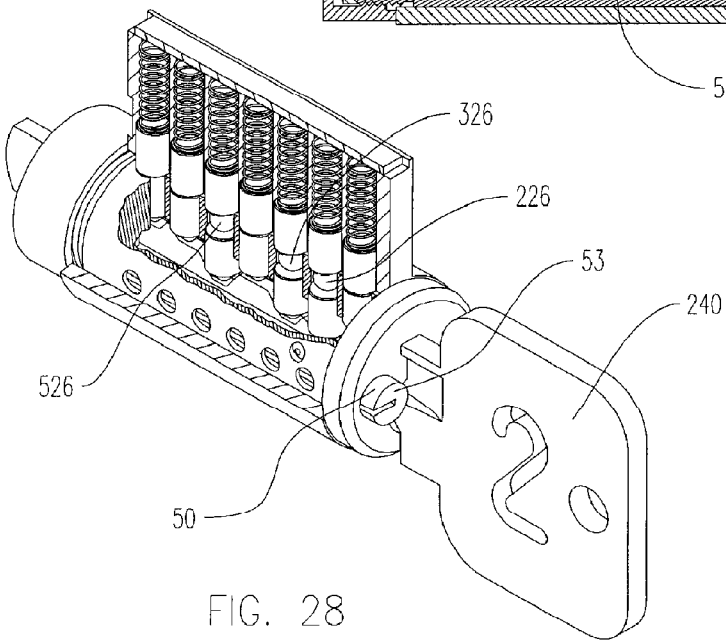
FIG. 28 shows a perspective view of the lock after the second user key has rotated the plug back to the key insertion position.

In a similar way, the lock of the second embodiment can be reset using the change tool 160 and the operable user key 40 when the lock is configured for operation by the operable user key 40, such as the lock configuration for the second user key 240 shown in FIGS. 27 and 28. In that circumstance, all the change balls 126, 426 and 626 would be raised out of their respective retainer cavities 156 by the inserted change tool 160, while the change balls 226, 326, and 526 are already within their corresponding tumbler chambers 13.

During normal lock operation and use, the cavity carriage 150 would be positioned in its non-aligned position shown in FIGS. 31 and 32, to avoid incidental keying and accidental reconfiguring of the active change balls disposed in the pin chamber, into their corresponding retainer cavities 156. The cavity carriage 150 would only require rotation to its aligned position, shown in FIGS. 29 and 33, when the user intended to move change members 26 into, or out of, the corresponding retainer cavities 156, for re-programming the lock.

A third embodiment of the lock is shown in FIGS. 35-39. The embodiment is otherwise the same as the first embodiment, except that the cavity carriage 250 of the third embodiment cooperates with a stationary, integral change tool 260 disposed within the plug 10. The cavity carriage 250, shown in FIG. 35, has a cylindrically-shaped body 252 that is configured to be disposed and moveable within the cylindrical bore 19. Although the illustrated cavity carriage 250 and its complementary-shaped bore 19 are shown having a circular cross sectional shape, other shapes such as rectilinear and oval can be used.

Figure 36A:
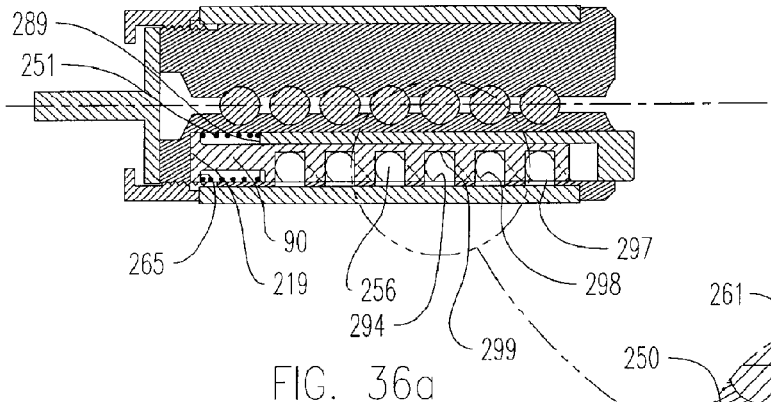
FIG. 36*a* shows a horizontal sectional view of the lock and the third cavity carriage through line 36*a*-36*a*.
Figure 36B:
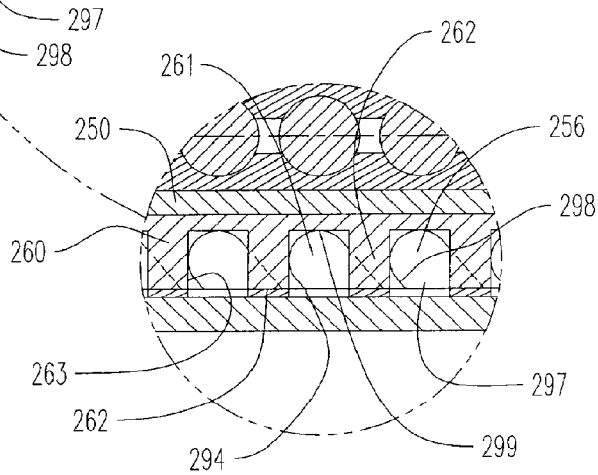
FIG. 36*b* shows an exploded view of a portion of FIG. 36*a*.

The cavity carriage 250 has a plurality of aligned retainer cavities 256 formed into the surface and along its length. The retainer cavities 256 are of substantially the same size, and have a pitch between adjacent retainer cavities 256 equivalent to the pitch of the driver chambers 24. The retainer cavities 256 differ however from the retainer cavities 56 of the earlier embodiment, in that the retainer cavity 256 has a centerline angled from vertical or orthogonal (perpendicular to the axis), forming sidewalls of elliptical or oval cross section. The retainer cavities 256 slant slightly rearward, away from the end 253, as the cavity descends from its opening 297 toward the centerline 400 of the body 252 to a bottom 299, as shown in FIGS. 36*a* and 36*b*. The retainer cavity 256 therefore has a slanted or angled sidewall 298, relative to the centerline 400 of the body 252. The shape of the retainer cavity 256 is conveniently round, although other shapes are usable. The diameter or minimum size of the retainer cavities 256 is at least slightly larger than the diameter or maximum size of the change ball 26.

Figure 38:
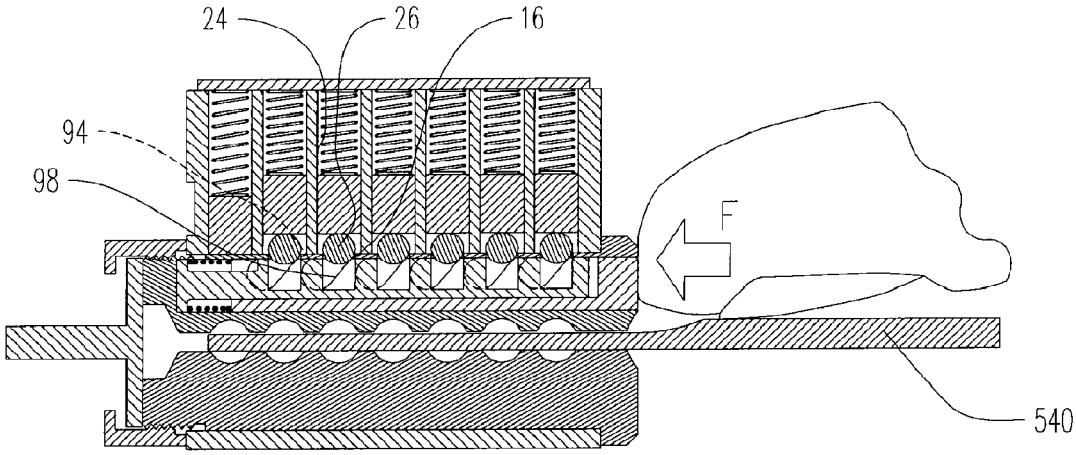
FIG. 38 shows the lock of FIG. 37 after depressing inward the cavity carriage, with the change balls partially dropping into the cavity carriage.

The cavity carriage body 252 also has a slot 254 formed into the body 252, oriented substantially parallel to, and typically along, the axial centerline 400. The slot 254 is illustrated as extending from inboard of the front end 253, toward and through a portion of the plurality of retainer cavities 256, and through the rear end 289 of the body 252. The slot 254 extends forward toward the front 53 sufficiently to accommodate the stationary tool 260 when the cavity carriage 250 is depressed, as shown in FIG. 38. The change slot 254 has a radial depth that is greater than the depth of the bottom 299 of the retainer cavities 256, to also accommodate the stationary tool 260, described below. The change slot 254 is typically configured with a minimum width that accommodates the width of the stationary tool 260, and is typically about 0.020 inches (about 0.50 mm) or less.

Cooperating with the slanted retainer cavities 256 and disposed within the change slot 254 is the stationary tool 260. The stationary tool 260 is configured as a shaped blade that is disposed within the change slot 254, and has a plurality of rectilinear pockets 261 defined by teeth 262, each tooth having a front-facing edge 263 and a rear-facing edge 264. The stationary tool 260 is biased against the rear wall 219 of the bore 19 by a biasing means shown as a spring 251 that is captured between the flange 265 at the rear end of the stationary tool 260, and the rear face 289 of the cavity carriage 250. The spring 251 biases the cavity carriage 250 towards its second, non-aligned position, shown in FIG. 37, and is compressed when the cavity carriage 250 is manipulated rearward to its first, aligned position shown in FIG. 38. The biasing force of the spring 251 disposes the stationary tool 260 in a position wherein each of the pockets 261 align with and are open toward the corresponding driver chambers 24 when the plug is in the programming position, as shown in each of the FIG. 37-39.

Figure 37:
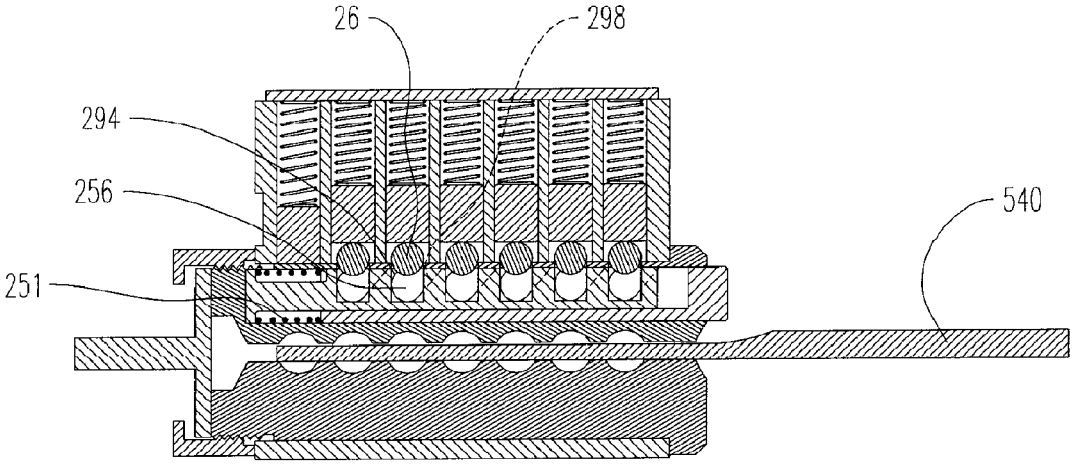
FIG. 37 shows a section view of the lock through line 37-37 of FIG. 35, after the programming key has been inserted and the plug rotated to the programming position.

The cavity carriage 250 moves within the bore 19 between a first position wherein the openings 297 to the plurality of slanted retainer cavities 256 are aligned with the plurality of driver chambers 24, shown in FIG. 38, when the plug 10 is rotated to the programming position, and a second position wherein the openings 297 to the slanted retainer cavities 256 are out of alignment with the plurality of driver chambers 24, shown in FIG. 37, when the cavity carriage 250 has been biased within the bore 19 toward the front of the plug by spring 251. The cavity carriage 250 can move longitudinally between the first and second positions substantially independent of the rotational position of the plug 10 within the housing 20.

The cavity carriage 250 has an elongated flat 257 that cooperates with the securing pin 58 disposed in the hole 59 to control the range of longitudinal movement of the cavity carriage 250 between its first and second longitudinal positions, as described for the first embodiment.

One can see that pressing the cavity carriage rearward against compressing spring 251 brings the retainer cavities 256 into alignment with the openings 16 in the periphery 12 and the driver chambers 24. If a change ball 26 is disposed within the driver chamber 24 when the carriage 250 is in the second, non-aligned position, as shown in FIG. 37, the rim edge 294 defining the opening 297 blocks the change ball 26 from passing into the slanted retainer cavity 256. In that same position, when the carriage 250 is moved to the first, aligned position, shown in FIG. 38, the rim edge 294 moves away from the opening 16 in the plug, allowing the change ball 26 to begin passing through the opening 16, and down along the slanted wall 298 of the retainer cavity 256. As the force F is released, and the carriage 250 is biased forward to the non-aligned position shown in FIG. 39, the descending change ball 26 will continue passing through the opening 16 in the plug, both within the pocket 261 between adjacent teeth 262 of the stationary tool 260, and down along the slanted sidewalls 298 of the retainer cavity 256, ultimately passing completely to the bottom 299 within the retainer cavity 256 and to the bottom of the pocket 261 of the stationary tool 260.

Figure 39:
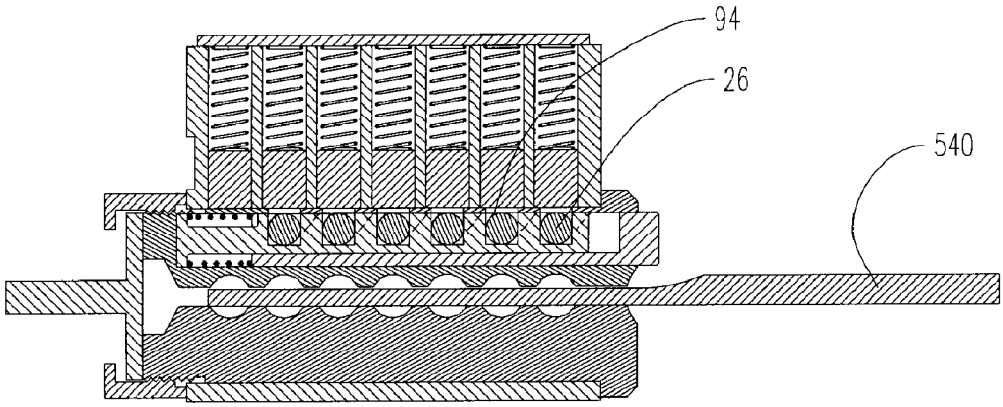
FIG. 39 shows the lock of FIG. 38 after the cavity carriage is released outward, with the change balls deposited into the cavity carriage.

If a change ball 26 is disposed within the bottom 299 of the slanted retainer cavity 256 as shown in FIG. 39, then movement out of the retainer cavity is accomplished by manipulating the carriage 250 rearward, as shown in FIG. 38. The slanted sidewalls 298 exert both longitudinal and vertical (upward) force upon the change ball 26, causing the change ball to move against and up along the forward surfaces 263 of teeth 262, eventually emerging through the opening 297 of the retainer cavity 256 and opening 16 in the periphery of the plug, and into driver chamber 24, as shown in FIG. 38. To isolate the change balls 26 in the corresponding driver chambers 24, the plug 10 is rotated away from the programming position while depressing or holding the carriage 250 in its aligned position, since merely releasing the carriage 250 would cause the change balls 26 to be driven back down into the corresponding retainer cavities 256.

In alternative embodiments of the present invention, the bore 19 and the cavity carriage 50, 150 and 250 can be disposed on the opposed side of the plug, whereby rotation of the plug to the programming position is in the counter clockwise direction.

Figure 40:
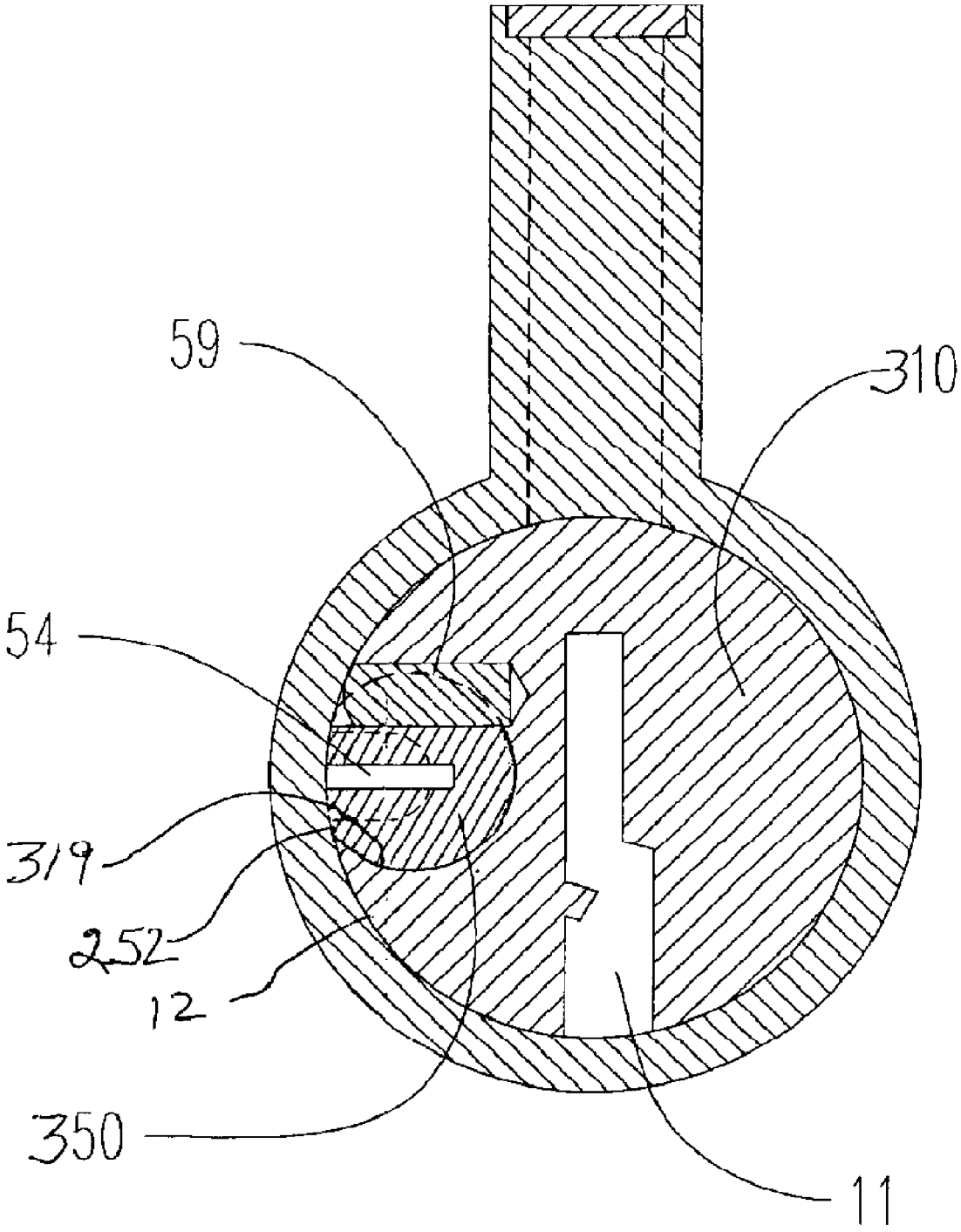
FIG. 40 shows a lateral sectional view of another embodiment of the programmable lock wherein the longitudinal bore is formed to intersect a portion of the periphery of the plug.

Another embodiment of the lock is shown in FIG. 40. The embodiment is otherwise the same as the first embodiment and/or the third embodiment, except that the cylindrical bore 319 for the cavity carriage 350 is formed to intersect the periphery 12 of the plug, thereby exposing a portion of the cavity carriage 350 directly through the periphery 12 of the plug. The portion of the body 252 of the cavity carriage 350 exposed through the periphery 12 of the plug is shaped to be flush with the periphery so that the plug and cavity carriage assembly can rotate within the housing.

In other embodiments of the present invention, a method is provided for using the lock by providing a means for rapidly changing the internal configuration of the drivers, tumblers and change balls of the lock to program the lock to operate, typically exclusively, with one user key of a set of user keys. The method of using the rapidly-changeable lock does not require disassembly, or removal of the plug from the housing, or re-pinning of the tumbler pins. The method involves inserting a programming key into the keyway of the lock that is configured to operate with a first user key. The inserted programming key provides for rotation of the plug in an opposite direction, to a programming position. The programming key also provides that any change ball disposed within the pin chambers is forced up into its respective driver chamber, and is subsequently deposited within its respective retainer cavity. In the programming position, the change balls remain isolated in the driver chambers. Next, the cavity carriage is manipulated, depending upon the embodiment used, either by depressing or rotating, or otherwise moving, the cavity carriage from its non-communicating position, into a communicating position, allowing the change ball to move from the driver chamber into the retainer cavity.

The method can also include moving the change member or ball from the retainer cavity back to the pin chamber, substantially as described in the above description.

The embodiments of a programmable lock assembly can be used in a variety of locking devices. These locking devices include both commercial and residential locks, and include by example, knob locks, deadbolt locks, and padlocks. The operation of a typical knob lock can include the use of the operable key both to unlock and lock the door knob by turning a latch that is secured to the latch end of the plug, or to provide only for unlocking of the latch. In the later embodiment, the latch typically unlocks the door knob, which can then turn or rotate by hand, and thereby operate an elongated bolt that engages and disengages the jamb of the door or other object that is being locked. The operation of a typical dead-bolt lock includes the use of the operable key to unlock and rotate a latch that drives an elongated bolt to engage and disengage the jamb of the door or other object that is being locked. These locks are well-known to one skilled in the art.

An advantage of the present lock assembly that employs a means for isolating the retainer cavities from the driver chambers when the plug is in the programming position, is that the programming key can operate as a master key. Master keys are used to operate or "open" the lock and unlatch the door or other device being secured closed by the lock, regardless of the user configuration of the lock and of which user key is operable. In the now conventional lock embodiments described in the aforementioned US patent Publication 2004-0221630, a master shim can be disposed in the driver/tumbler pin stack directly beneath the change member. The master shim is shaped as a flattened disc, typically having a thickness less than its diameter, and typically having a diameter substantially the same as the diameter of the driver pins. When a master key is inserted, the top edge of the tumblers are raised to the shear line, and any master shim and any and all change members in the pin stack positioned above the tumbler are raised into the driver chamber. When the lock is operated and the plug is rotated to the programming position, the master shims, due to their larger size, block the change members in the driver chambers from dropping into the corresponding retainer cavities. Without the master shims, use of the master key would place the lock into the "lockout" configuration. Use of the master shims allows the master key to open any lock in a particular facility system without reconfiguring the driver/tumbler stack of the lock.

However, in the lock embodiments of the present lock assembly, the isolating means in its first position prevents the spontaneous movement of a change member or ball from moving from the driver chamber into the corresponding retainer cavity. Therefore, even though the programming key raises all of the change members in the pin chambers above the shear line, and as such acts as a master key, the lock will not spontaneously be placing into lockout configuration when the plug is rotated to the programming position, due to the isolating means. Manipulating or placing the isolating means into its second position selectively allows the change members to be moved into the retainer cavities to place the lock into its lock-out position.

Nevertheless, in alternative embodiments of the lock assembly, one or more master pins or shims can be installed within one or more of the plurality of pin chambers, typically one or more of the most rearward pin chambers. The addition of one or more master pins in the lock assemblies adds additional master keying capacity.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

I claim:

1. A programmable cylinder lock for operating a bolt or a latch, that can be reconfigured to operate with a user key selected from a set of keys, without disassembling the lock or replacing the tumblers, including:

a. a set of keys comprising a plurality of user keys;

b. a housing having a cylindrical bore with an inner surface and a plurality of driver chambers intersecting the inner surface;

c. a plurality of drivers, each driver being movable within one of the plurality of driver chambers, and having a means for urged each driver toward the inner surface;

d. a plug having a cylindrical periphery and rotatably mounted within the bore so as to form a shear surface at the interface with the inner surface, the plug being rotatable from a key insertion position to an operating position, and to a programming position, the plug having:

i) a keyway configured to receive a key selected from the set of keys, ii) a plurality of tumbler chambers intersecting the plug periphery and the keyway, each tumbler chamber being aligned with a corresponding one of the plurality of driver chambers when the plug is at the key insertion position to form a pin chamber, and iii) at least one retainer cavity disposed within the plug, spaced apart from a corresponding one of the plurality of tumbler chambers, and being alignable with the corresponding driver chamber when the plug is at the programming position;

e. a plurality of tumblers, each tumbler being movable within a corresponding one of the plurality of tumbler chambers;

f. at least one lock configuration change ball, movable within the lock between at least a second position within the at least one retainer cavity, and a first position within the corresponding driver chamber; and g. a cavity carriage movably positioned within the plug, and forming a portion of the periphery of the plug, within which the at least one retainer cavity is formed, the cavity carriage movable relative to the plug between a first aligned position wherein the at least one retainer cavity is aligned with the corresponding driver chamber when the plug is in the programming position, and the change ball can be moved between the at least one retainer cavity and the corresponding driver chamber, and a second non-aligned position wherein the at least one retainer cavity is not aligned with the corresponding driver chamber, and the change ball cannot be moved between the at least one retainer cavity and the corresponding driver chamber when the plug is in the programming position.

2. The cylinder lock according to claim 1, further comprising a means for moving the change ball from the at least one retainer cavity into the corresponding driver chamber.

3. The cylinder lock according to claim 1, wherein the cavity carriage moves longitudinally within a second channel along a longitudinal axis of the cavity carriage.

4. The cylinder lock according to claim 3, further comprising a means for biasing the cavity carriage longitudinally to its second, non-aligned position, and a means for manipulating the cavity carriage with a force to move the cavity carriage longitudinally to its first, aligned position.

5. The cylinder lock according to claim 4, wherein the cavity carriage has a slot formed through the at least one retainer cavity, extending through an end of the cavity carriage, and further comprising a change tool comprising a blade for inserting into the slot to intersect the at least one retainer cavity.

6. The cylinder lock according to claim 3, wherein the at least one retainer cavity has a slanted centerline and sidewall, wherein the cavity carriage further has a slot formed through the at least one retainer cavity, and further comprising a stationary change tool disposed within the slot of the cavity carriage, the stationary tool being fixed in position with respect to the plug and further having at least one pocket having sidewalls and positioned to align with the driver chamber.

* * * * *